US011505894B2

(12) United States Patent
El Hedok et al.

(10) Patent No.: US 11,505,894 B2
(45) Date of Patent: Nov. 22, 2022

(54) ARTICLES INCLUDING FIBROUS SUBSTRATES AND POROUS POLYMERIC PARTICLES AND METHODS OF MAKING SAME

(71) Applicant: 3M INNOVATIVE PROPERTIES COMPANY, St. Paul, MN (US)

(72) Inventors: Ibrahim A. El Hedok, Woodbury, MN (US); Hassan Sahouani, Hastings, MN (US); Jennifer N. Hanson, St. Paul, MN (US); Bradley W. Eaton, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 494 days.

(21) Appl. No.: 15/512,862

(22) PCT Filed: Sep. 28, 2015

(86) PCT No.: PCT/US2015/052564
§ 371 (c)(1),
(2) Date: Mar. 21, 2017

(87) PCT Pub. No.: WO2016/053830
PCT Pub. Date: Apr. 7, 2016

(65) Prior Publication Data

US 2017/0327998 A1 Nov. 16, 2017

Related U.S. Application Data

(60) Provisional application No. 62/058,419, filed on Oct. 1, 2014.

(51) Int. Cl.
*D06M 15/263* (2006.01)
*D06M 15/267* (2006.01)
(Continued)

(52) U.S. Cl.
CPC ..... *D06M 15/263* (2013.01); *D06M 15/267* (2013.01); *D06M 15/27* (2013.01);
(Continued)

(58) Field of Classification Search
None
See application file for complete search history.

(56) References Cited

U.S. PATENT DOCUMENTS 3,921,636 A 11/1975 Zaffaroni
4,429,001 A 1/1984 Kolpin
(Continued)

FOREIGN PATENT DOCUMENTS

CN 1685106 10/2005
EP 0156649 3/1985
(Continued)

OTHER PUBLICATIONS

"Hollow", Dictionary.com; accessed at https://www.dictionary.com/browse/hollow?s=t, Jul. 5, 2020. (Year: 2020).*
(Continued)

*Primary Examiner* — Alicia Chevalier
*Assistant Examiner* — Elaine M Vazquez
(74) *Attorney, Agent, or Firm* — Adrian L. Pishko

(57) ABSTRACT

Articles are provided that include a fibrous substrate and porous polymeric particles. At least 50% of the porous polymeric particles are bound to the fibrous substrate. Methods of making the articles are provided that include providing porous polymeric particles, providing a fibrous substrate, and binding the porous polymeric particles to the fibrous substrate. The articles can be used for fluid management.

20 Claims, 5 Drawing Sheets

(51) Int. Cl.
*D06M 15/27* (2006.01)
*D06M 23/08* (2006.01)
*D06M 15/53* (2006.01)

(52) U.S. Cl.
CPC ..... *D06M 15/53* (2013.01); *D06M 23/08* (2013.01); *D06M 2200/10* (2013.01); *D06M 2200/11* (2013.01)

(56) References Cited

U.S. PATENT DOCUMENTS

| | | | | |
|---|---|---|---|---|
| 4,755,178 | A | 7/1988 | Insley | |
| 4,806,360 | A | 2/1989 | Leong et al. | |
| 5,156,843 | A * | 10/1992 | Leong | A01N 25/18 424/411 |
| 5,316,774 | A | 5/1994 | Eury et al. | |
| 5,993,935 | A * | 11/1999 | Rasmussen | B01J 20/28004 264/175 |
| 6,048,908 | A | 4/2000 | Kitagawa | |
| 6,863,921 | B2 | 3/2005 | Nakamura | |
| 7,303,816 | B2 | 12/2007 | Nakamura | |
| 7,625,955 | B2 | 12/2009 | Gentilcore et al. | |
| 2006/0096911 | A1 | 5/2006 | Brey | |
| 2010/0068525 | A1 | 3/2010 | Jung | |
| 2010/0104647 | A1 | 4/2010 | Ting | |
| 2010/0311850 | A1 * | 12/2010 | Wickert | B01D 15/00 521/61 |
| 2011/0123456 | A1 | 5/2011 | Pandit | |
| 2014/0309314 | A1 | 10/2014 | Sahouani | |

FOREIGN PATENT DOCUMENTS

| | | |
|---|---|---|
| EP | 2545976 | 1/2013 |
| JP | 03-234874 | 10/1991 |
| JP | 05-209309 | 8/1993 |
| JP | 2005-076145 | 3/2005 |
| JP | 2008-237430 | 10/2008 |
| JP | 2009-174114 | 8/2009 |
| JP | 2011-503293 | 1/2011 |
| WO | WO 2007-075442 | 7/2007 |
| WO | WO 2007-075508 | 7/2007 |
| WO | WO 2009-061759 | 5/2009 |
| WO | WO 2013-077981 | 5/2013 |
| WO | WO 2014-186328 | 11/2014 |
| WO | WO 2014-186336 | 11/2014 |
| WO | WO 2015-095100 | 6/2015 |

OTHER PUBLICATIONS

International Search Report for PCT International Application No. PCT/US2015/052564, dated Jan. 4, 2016, 4 pgs.

* cited by examiner

ARTICLES INCLUDING FIBROUS SUBSTRATES AND POROUS POLYMERIC PARTICLES AND METHODS OF MAKING SAME

CROSS REFERENCE TO RELATED APPLICATIONS

This application is a national stage filing under 35 U.S.C. 371 of PCT/US2015/052564, filed Sep. 28, 2015, which claims the benefit of U.S. Application No. 62/058419, filed Oct. 1, 2014, the disclosure of which is incorporated by reference in its/their entirety herein.

FIELD

Porous articles including polymeric particles and methods of making the porous articles are provided.

BACKGROUND

It is often desired to have a fabric with fluid management properties, e.g. a material that has the ability to absorb, wick, and evaporate fluids. These properties are desired for applications where continuous fluids management is needed, such as in adhesive bandages. Cellulosic nonwovens have the ability to absorb and wick water, for instance; however, they tend to hold on to water and often lose their structural integrity. Other super absorbing materials, e.g. sodium polyacrylate fibers, can absorb high levels of moisture, yet undergo significant swell that leads to dimensional changes in the material.

Various polymeric particles having pores have been prepared. Some of these have been used, for example, as ion exchange resins or other chromatographic resins. Others have been used, for example, to adsorb and/or deliver different active agents. Such particles are described, for example, in U.S. Patent Application 2010/0104647 (Ting), U.S. Patent Application Publication 2011/0123456 (Pandidt et al.), U.S. Pat. No. 6,048,908 (Kitagawa), and Patent Application Publications WO 2013/077981 (Sahouani), WO 2007/075508 (Rasmussen et al.), and WO 2007/075442 (Ramussen et al.).

SUMMARY

Porous articles are provided that include a fibrous substrate and porous polymeric particles bound to the fibrous substrate. The article can be used for fluid management applications. More particularly, the articles can be used for wicking and evaporating fluids, and optionally contain an antimicrobial agent.

In a first aspect, an article is provided. The article includes 1) a fibrous substrate and 2) porous polymeric particles, wherein at least 50% of the porous polymeric particles are bound to the fibrous substrate. The porous polymeric particles include a polymerized product of a reaction mixture that contains 1) a first phase having a first volume and 2) a second phase having a second volume and being dispersed in the first phase, wherein the first volume is greater than the second volume. The first phase contains i) a compound of Formula (II)

$$HO(—CH_2CH(OH)CH_2O)n—H \quad (II)$$

wherein the variable n is an integer equal to at least 1 and ii) a nonionic surfactant. The second phase contains i) a monomer composition and ii) a poly(propylene glycol) having a weight average molecular weight of at least 500 grams/mole. The monomer composition contains at least 10 weight percent of a first monomer of Formula (I)

$$CH_2{=}C(R^1)—(CO)—O[—CH_2—CH_2—O]_p—(CO)—C(R^1){=}CH_2 \quad (I)$$

based on a total weight of the monomer composition. In Formula (I), the variable p is an integer equal to at least 1 and $R^1$ is hydrogen or alkyl. The poly(propylene glycol) is removed from the polymerized product to provide the porous polymeric particles.

In one embodiment of the first aspect, the reaction mixture used to form the porous polymeric particles includes (a) a first phase and (b) a second phase dispersed in the first phase, wherein a volume of the first phase is greater than a volume of the second phase. The first phase contains (i) a compound of Formula (II)

$$HO[—CH_2—CH(OH)—CH_2—O]_n—H \quad (II)$$

where the variable n is an integer equal to at least 1 and (ii) a nonionic surfactant. The second phase contains (i) a monomer composition containing at least 10 weight percent of the first monomer of Formula (I)

$$CH{=}C(R^1)—(CO)—O[—CH_2—CH_2—O]_p—(CO)—C(R^1){=}CH_2 \quad (I)$$

based on the total weight of the monomer composition and (ii) the poly(propylene glycol) having a weight average molecular weight of at least 500 grams/mole. In Formula (I), the variable p is an integer equal to at least 1 and the group $R^1$ is hydrogen or methyl.

In a second aspect, a method of making an article is provided. The method includes a) providing a plurality of porous polymeric particles, b) providing a fibrous substrate comprising fibers, and c) binding the porous polymeric particles to the fibrous substrate. At least 50% of the porous polymeric particles are bound to the fibrous substrate. The porous polymeric particles include a polymerized product of a reaction mixture that contains 1) a first phase having a first volume and 2) a second phase having a second volume and being dispersed in the first phase, wherein the first volume is greater than the second volume. The first phase contains i) a compound of Formula (II)

$$HO(—CH_2CH(OH)CH_2O)n—H \quad (II)$$

wherein the variable n is an integer equal to at least 1 and ii) a nonionic surfactant. The second phase contains i) a monomer composition and ii) a poly(propylene glycol) having a weight average molecular weight of at least 500 grams/mole. The monomer composition contains at least 10 weight percent of a first monomer of Formula (I)

$$CH_2{=}C(R^1)—(CO)—O[—CH_2—CH_2—O]_p—(CO)—C(R^1){=}CH_2 \quad (I)$$

based on a total weight of the monomer composition. In Formula (I), the variable p is an integer equal to at least 1 and the group $R^1$ is hydrogen or alkyl. The poly(propylene glycol) is removed from the polymerized product to provide the porous polymeric particles.

DETAILED DESCRIPTION

Figure 1:
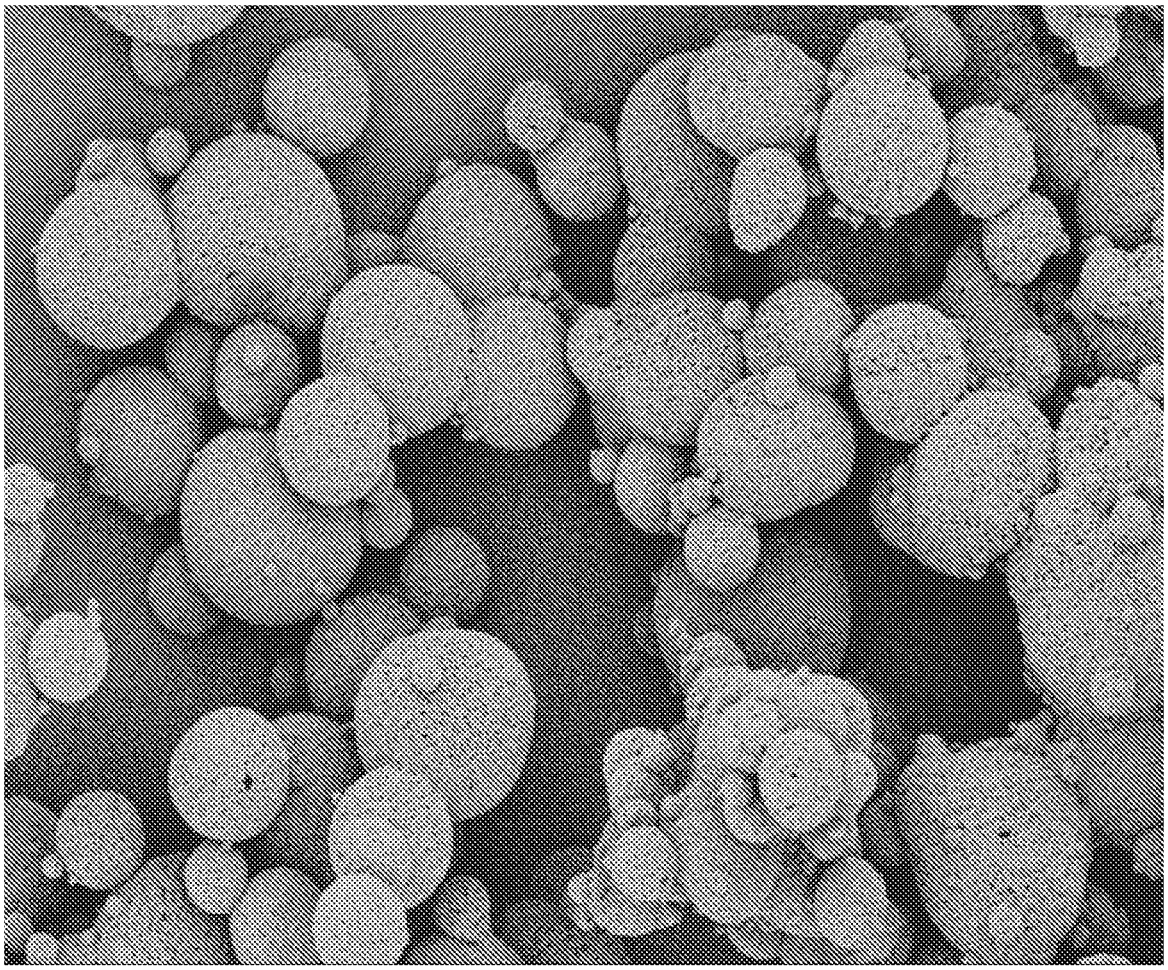
FIG. 1 is the scanning electron micrograph (SEM) of porous polymeric particles prepared as described in Preparatory Example 1.

Articles are provided that include a fibrous substrate and porous polymeric particles bound to the fibrous substrate. The article can be used for fluid management applications. More particularly, the articles can be used for wicking and evaporating fluids, and optionally contain an antimicrobial agent.

Both the porous polymeric particles and the fibrous substrate have voids or free volume. The voids in the fibrous substrate allow fluid to wick across a length of the substrate and come into contact with the porous polymeric particles bound to the fibrous substrate. The porous polymeric particles have pores on its outer surface and, at least in some embodiments, can have hollow interiors. The terms "porous polymeric particle" and "polymeric particle" are used interchangeably.

The terms "polymer" and "polymeric material" are used interchangeably and refer to materials formed by reacting one or more monomers. The terms include homopolymers, copolymers, terpolymers, or the like. Likewise, the terms "polymerize" and "polymerizing" refer to the process of making a polymeric material that can be a homopolymer, copolymer, terpolymer, or the like.

The term "a", "an", and "the" are used interchangeably with "at least one" to mean one or more of the elements being described.

The term "and/or" means either or both. For example "A and/or B" means only A, only B, or both A and B.

The term "bound", relating to porous polymeric particles being bound to one or more fibers of the fibrous substrate, means being attached by being fused or by being adhered using an adhesive or polymeric binder, as opposed to being held by physical interactions (for example, adsorption or mechanical entrapment). The polymeric binder excludes binder fibers, such as the binder fibers typically employed in wet-laying techniques.

The term "fused" means directly connected together. Often, porous polymeric particles are fused to the fibrous substrate by heating the fibrous substrate to a temperature above the glass transition temperature of the fibers, contacting the particles with the heated substrate, and cooling the particles and substrate. After cooling, porous polymeric particles are directly connected to the fibrous substrate.

The term "monomer composition" refers to that portion of a polymerizable composition that includes the monomers and only the monomers. More specifically, the monomer composition includes at least the first monomer of Formula (I). The term "reaction mixture" includes, for example, the monomer composition, the poly(propylene glycol), any other components such as those included in the first phase and the second phase described below. Some of the components in the reaction mixture but may not undergo a chemical reaction but can influence the chemical reaction and the resulting polymeric material.

The term "meltblown process" refers to making fine fibers by extruding a thermoplastic polymer through a die consisting of one or more holes. As the fibers emerge from the die they are attenuated by an air stream that is run more or less in parallel or at a tangent to the emerging fibers.

In a first aspect, an article is provided. The article comprises a) porous polymeric particles and b) a fibrous porous matrix, wherein the porous polymeric particles are distributed throughout the fibrous porous matrix. The porous polymeric particles include a polymerized product of a reaction mixture that that contains i) a monomer composition and ii) a poly(propylene glycol) having a weight average molecular weight of at least 500 grams/mole. The monomer composition contains at least 10 weight percent of a first monomer of Formula (I)

$$CH_2{=}C(R^1){-}(CO){-}O[{-}CH_2{-}CH_2{-}O]_p{-}(CO){-}C(R^1){=}CH_2 \quad (I)$$

based on a total weight of the monomer composition. In Formula (I), the variable p is an integer equal to at least 1 and $R^1$ is hydrogen or alkyl.

The variable p in Formula (I) is an integer no greater than 30, no greater than 20, no greater than 16, no greater than 12, or no greater than 10. The number average molecular weight of the ethylene oxide portion of the monomer (i.e., the group $-[CH_2CH_2-O]_p-$) is often no greater than 1200 grams/mole, no greater 1000 grams/mole, no greater than 800 grams/mole, no greater than 1000 grams, mole, no greater than 600 grams/mole, no greater than 400 grams/mole, no greater than 200 grams/mole, or no greater than 100 grams/mole. The group $R^1$ in Formula (I) is hydrogen or methyl.

Suitable first monomers of Formula (I) are commercially available from Sartomer (Exton, Pa., USA) under the trade designation SR206 for ethylene glycol dimethacrylate, SR231 for diethylene glycol dimethacrylate, SR205 for triethylene glycol dimethacrylate, SR210 and SR210A for polyethylene glycol dimethacrylate, SR259 for polyethylene glycol (200) diacrylate, SR603 and SR344 for polyethylene glycol (400) di(meth)acrylate, SR252 and SR610 for polyethylene glycol (600) di(meth)acrylate, and SR740 for polyethylene glycol (1000) dimethacrylate.

The reaction mixture used to form the porous polymeric particles also includes a poly(propylene glycol) having a weight average molecular weight of at least 500 grams/mole. The polypropylene glycol functions as a porogen that gets partially entrained within the polymerized product as it forms from the monomer composition. Because the polypropylene glycol has no polymerizable group, this material can be removed after formation of the polymerized product. Pores (i.e., void volume or free volume) are created when the previously entrained polypropylene glycol is removed. The polymeric particles resulting from the removal of the entrained polypropylene glycol are porous. In certain embodiments, at least some of these porous polymeric particles can have hollow centers, and thus be in the form of hollow beads. The presence of pores or the presence of both pores and hollow centers make the polymeric particles well suited for absorbing and wicking fluids, as well as holding active agents.

Any suitable molecular weight of poly(propylene glycol) can be used as the porogen. The molecular weight can affect the size of the pores that are formed in the polymeric particles. That is, the pore size tends to increase with the molecular weight of the poly(propylene glycol). The weight average molecular weight is often at least 500 grams/mole, at least 800 grams/mole, or at least 1000 grams/mole. The weight average molecular weight of the poly(propylene glycol) can be up to 10,000 gram/mole or greater. For ease of use, a poly(propylene glycol) that is a liquid at room temperature is often selected. Poly(propylene glycol) having a weight average molecular weight up to about 4000 grams/mole or 5000 grams/mole tends to be a liquid at room temperature. Poly(propylene glycol) that is not a liquid at room temperature can be used if it is initially dissolved in a suitable organic solvent such as an alcohol (for example, ethanol, n-propanol, or iso-propanol). The weight average molecular weight of the poly(propylene glycol) is often in a range of 500 to 10,000 grams/mole, in a range of 1000 to 10,000 grams/mole, in a range of 1000 to 8000 grams/mole, in a range of 1000 to 5000 grams/mole, in a range of 1000 to 4000 grams/mole.

In many embodiments of the first aspect, the reaction mixture used to form the porous polymeric particles includes (a) a first phase and (b) a second phase dispersed in the first phase, wherein a volume of the first phase is greater than a volume of the second phase. The first phase contains (i) a compound of Formula (II)

$$HO[—CH_2—CH(OH)—CH_2—O]_n—H \quad (II)$$

where the variable n is an integer equal to at least 1, and (ii) a nonionic surfactant. The second phase contains (i) a monomer composition comprising the monomer of Formula (I) as described above and (ii) a poly(propylene glycol) having a weight average molecular weight of at least 500 grams/mole. The second phase of the reaction mixture is dispersed in the first phase of the reaction mixture and the volume of the first phase is greater than the volume of the second phase. That is, the first phase can be considered to be the continuous phase and the second phase can be considered to be the dispersed phase within the continuous phase. The first phase provides a non-polymerizable medium for suspending the second phase as droplets within the reaction mixture. The second phase droplets include i) a monomer composition that can undergo polymerization and ii) a porogen, which is poly(propylene glycol) having a weight average molecular weight of at least 500 grams/mole. The monomer of Formula (I) in the second phase is typically not miscible with the first phase.

The first phase of the reaction mixture includes (i) the compound of Formula (II) and (ii) a nonionic surfactant. The first phase is typically formulated to provide a suitable viscosity and volume for dispersion of the second phase as droplets within the first phase. If the viscosity of the first phase is too high, it can be difficult to provide the requisite shear to disperse the second phase. If the viscosity is too low, however, it can be difficult to suspend the second phase and/or to form polymeric particles that are relatively uniform and well separated from each other.

Suitable compounds of Formula (II) typically have a value of n that is in a range of 1 to 20, in a range of 1 to 16, in a range of 1 to 12, in a range of 1 to 10, in a range of 1 to 6, or in a range of 1 to 4. In many embodiments, the compound of Formula (II) is glycerol where the variable n is equal to 1. Other example compounds of Formula (II) are diglycerol (n is equal to 2), polyglycerol-3 (n is equal to 3), polyglycerol-4 (n is equal to 4), or polyglycerol-6 (n is equal to 6). The polyglycerols, which can be referred to as polyglycerins, are often a mixture of materials with varying molecular weight (i.e., materials with different values for n). Polyglycerols, diglycerol, and glycerol are commercially available, for example, from Solvay Chemical (Brussels, Belgium) and Wilshire Technologies (Princeton, N.J., USA).

In addition to the compound of Formula (II), the first phase includes a nonionic surfactant. The nonionic surfactant increases the porosity on the surface of the final polymeric particles. The first phase is typically free or substantially free of an ionic surfactant that could interfere with the polymerization reaction of the monomers within the second phase. As used herein with reference to the ionic surfactant, the term "substantially free" means that no ionic surfactant is purposefully added to the first phase but may be present as a trace impurity in one of the other components in the first phase. Any impurity is typically present in an amount no greater than 0.5 weight percent, no greater than 0.1 weight percent, or no greater than 0.05 weight percent, or no greater than 0.01 weight percent based on a total weight of the first phase.

Any suitable nonionic surfactant can be used in the first phase. The nonionic surfactant often has hydroxyl group or ether linkages (for example, $—CH_2—O—CH_2—$) in one portion of the molecule that can hydrogen bond with other components of the reaction mixture. Suitable nonionic surfactants include, but are not limited to, alkyl glucosides, alkyl glucamides, alkyl polyglucosides, polyethylene glycol alkyl ethers, block copolymers of polyethylene glycol and polypropylene glycol, and polysorbates. Examples of suitable alkyl glucosides include, but are not limited to, octyl glucoside (also referred to as octyl-beta-D-glucopyranoside) and decyl glucoside (also referred to as decyl-beta-D-glucopyranoside). Examples of suitable alkyl glucamides include, but are not limited to, octanoyl-N-methylglucamide, nonanoyl-N-methylglucamide, and decanoyl-N-methylglucamide. These surfactants can be obtained, for example, from Sigma Aldrich (St. Louis, Mo., USA) or Spectrum Chemicals (New Brunswick, N.J., USA). Examples of suitable alkyl polyglucosides include, but are not limited to, those commercially available from Cognis Corporation (Monheim, Germany) under the trade designation APG (for example, APG 325) and those commercially available from Dow Chemical (Midland, Mich., USA) under the trade designation TRITON (for example, TRITON BG-10 and TRITON CG-110). Examples of polyethylene glycol alkyl ethers include, but are not limited to, those commercially available under the trade designation BRIJ (for example, BRIJ 58 and BRIJ 98) from Sigma Aldrich (St. Louis, Mo., USA). Examples of block copolymers of polyethylene glycol and polypropylene glycol include, but are not limited to, those commercially available under the trade designation PLURONIC from BASF (Florham Park, N.J., USA). Examples of polysorbates include, but are not limited, to those commercially available under the trade designation TWEEN from ICI American, Inc. (Wilmington, Del. USA).

The surfactant can be present in the first phase in any suitable amount. Often, the surfactant is present in an amount equal to at least 0.5 weight percent, at least 1 weight percent, or at least 2 weight percent based on a total weight of the first phase. The surfactant can be present in an amount up to 15 weight percent, up to 12 weight percent, or up to 10 weight percent based on a total weight of the first phase. For example, the surfactant is often present in the first phase in an amount in a range of 0.5 to 15 weight percent, in a range of 1 to 12 weight percent, in a range of 0.5 to 10 weight percent, or in a range of 1 to 10 weight percent based on the total weight of the first phase.

Optionally, water or an organic solvent that is miscible with the compound of Formula (II) can be present in the first reaction mixture. Suitable organic solvents include, for example, an alcohol such as methanol, ethanol, n-propanol, or isopropanol. The amount of any optional water or organic solvent is selected so that the desired viscosity of the first phase can be achieved. The amounts of the optional water or organic solvent is often no greater than 10 weight percent, no greater than 5 weight percent, or no greater than 1 weight percent based on the total weight of the first phase. If higher amounts of water are included, the porosity may decrease. In some embodiments, the first phase is free or substantially free of the optional water or organic solvent. As used herein with reference to the optional water or organic solvent, the term "substantially free" means that water or organic solvent is not purposely added to the first phase but may be present as an impurity in one of the other components in the first phase. For example, the amount of the optional water or organic solvent is less than 1 percent, less than 0.5 weight percent, or less than 0.1 weight percent based on a total weight of the first phase.

The reaction mixture includes a second phase dispersed in the first phase. The second phase includes both i) a monomer composition and ii) a poly(propylene glycol) having a weight average molecular weight of at least 500 grams/mole. The monomer composition is polymerized in the second phase to from the polymeric particles. The polypropylene glycol functions as a porogen that gets partially entrained within the polymerized product as it is formed from the monomer composition.

The volume of the first phase is greater than the volume of the second phase. The volume of the first phase is sufficiently large compared to the volume of the second phase so that the second phase can be dispersed in the form of droplets within the first phase. Within each droplet, the monomer composition is polymerized to form a polymerized product. To form particles from the second phase, the volume ratio of the first phase to the second phase is typically at least 2:1. As the volume ratio increases (for example, when the ratio is at least 3:1, at least 4:1, or at least 5:1), beads can be formed that have a relatively uniform size and shape. If the volume ratio is too large, however, the reaction efficiency is diminished (i.e., a smaller amount of polymeric particles is produced). The volume ratio is generally no greater than 25:1, no greater than 20:1, no greater than 15:1, or no greater than 10:1.

In some embodiments, the first monomer of Formula (I) as described above is the only monomer in the monomer composition of the second phase. In other embodiments, the first monomer of Formula (I) can be used in combination with at least one second monomer. The second monomer has a single free radically polymerizable group such as an ethylenically unsaturated group, which is often a (meth) acryloyl group of formula $H_2C{=}CR^1{-}(CO){-}$ where $R^1$ is hydrogen or methyl. Suitable second monomers are not miscible with the first phase but can be miscible or not miscible with the first monomer of Formula (I). The second monomer is often added to alter the hydrophobicity or hydrophilicity of the porous polymeric material. The addition of these monomers can, however, diminish the porosity of the polymeric particles and/or increase the size of the polymeric particles.

Some example second monomers are of Formula (III).

$$CH_2{=}CR^1{-}(CO){-}O{-}Y{-}R^2 \quad \text{(III)}$$

In this formula, group $R^1$ is hydrogen or methyl. In many embodiments, $R^1$ is hydrogen. Group Y is a single bond, alkylene, oxyalkylene, or poly(oxyalkylene). Group $R^2$ is a carbocyclic group or heterocyclic group. These second monomers tend to be miscible with the first monomer of Formula (I) in the second phase but are not miscible with the first phase.

As used herein, the term "alkylene" refers to a divalent group that is a radical of an alkane and includes groups that are linear, branched, cyclic, bicylic, or a combination thereof. As used herein, the term "oxyalkylene" refers to a divalent group that is an oxy group bonded directly to an alkylene group. As used herein, the term "poly(oxyalkylene)" refers to a divalent group having multiple oxyalkylene groups. Suitable Y alkylene and oxyalkylene groups typically have 1 to 20 carbon atoms, 1 to 16 carbon atoms, 1 to 12 carbon atoms, 1 to 10 carbon atoms, 1 to 8 carbon atoms, 1 to 6 carbon atoms, or 1 to 3 carbon atoms. The oxyalkylene is often oxyethylene or oxypropylene. Suitable poly(oxyalkylene) groups typically have 2 to 20 carbon atoms, 2 to 16 carbon atoms, 2 to 12 carbon atoms, 2 to 10 carbon atoms, 2 to 8 carbon atoms, 2 to 6 carbon atoms, or 2 to 4 carbon atoms. The poly(oxyalkylene) is often poly (oxyethylene), which can be referred to as poly(ethylene oxide) or poly(ethylene glycol).

Carbocyclic $R^2$ groups can have a single ring or can have multiple rings such as fused rings or bicylic rings. Each ring can be saturated, partially unsaturated, or unsaturated. Each ring carbon atom can be unsubstituted or substituted with alkyl groups. Carbocyclic groups often have 5 to 12 carbon atoms, 5 to 10 carbon atoms, or 6 to 10 carbon atoms. Examples of carbocyclic groups include, but are not limited to, phenyl, cyclohexyl, cyclopentyl, isobornyl, and the like. Any of these carbocyclic groups can be substituted with an alkyl group having 1 to 20 carbon atoms, 1 to 10 carbon atoms, 1 to 6 carbon atoms, or 1 to 4 carbon atoms.

Heterocyclic $R^2$ groups can have a single ring or multiple rings such as fused rings or bicyclic rings. Each ring can be saturated, partially unsaturated, or unsaturated. The heterocyclic group contains at least one heteroatom selected from oxygen, nitrogen, or sulfur. The heterocyclic group often has 3 to 10 carbon atoms and 1 to 3 heteroatoms, 3 to 6 carbon atoms and 1 to 2 heteroatoms, or 3 to 5 carbon atoms and 1 to 2 heteroatoms. Examples of heterocyclic rings include, but are not limited to, tetrahydrofurfuryl.

Exemplary monomers of Formula (III) for use as the second monomer include, but are not limited to, benzyl (meth)acrylate, 2-phenoxyethyl (meth)acrylate (commercially available from Sartomer under the trade designation SR339 and SR340), isobornyl (meth)acrylate, tetrahydrofurfuryl (meth)acrylate (commercially available from Sartomer under the trade designation SR285 and SR203), 3,3,5-trimethylcyclohexyl (meth)acrylate (commercially available from Sartomer under the trade designation CD421 and CD421A), and ethoxylated nonyl phenol acrylate (commercially available from Sartomer under then trade designation SR504, CD613, and CD612).

Other example second monomers are alkyl (meth)acrylates of Formula (IV).

$$CH_2{=}CR^1{-}(CO){-}O{-}R^3 \quad \text{(IV)}$$

In Formula (IV), group $R^1$ is hydrogen or methyl. In many embodiments, $R^1$ is hydrogen. Group $R^3$ is a linear or branched alkyl having 1 to 20 carbon atoms, 1 to 10 carbon atoms, 1 to 6 carbon atoms, or 1 to 4 carbon atoms. These second monomers tend to be miscible with the first monomer of Formula (I) in the second phase but are not miscible with the first phase.

Examples of alkyl (meth)acrylates of Formula (IV) include, but are not limited to, methyl (meth)acrylate, ethyl (meth)acrylate, n-propyl (meth)acrylate, isopropyl (meth) acrylate, n-butyl (meth)acrylate, isobutyl (meth)acrylate, n-pentyl (meth)acrylate, 2-methylbutyl (meth)acrylate, n-hexyl (meth)acrylate, 4-methyl-2-pentyl (meth)acrylate, 2-ethylhexyl (meth)acrylate, 2-methylhexyl (meth)acrylate, n-octyl (meth)acrylate, isooctyl (meth)acrylate, 2-octyl (meth)acrylate, isononyl (meth)acrylate, isoamyl (meth) acrylate, n-decyl (meth)acrylate, isodecyl (meth)acrylate, 2-propylheptyl (meth)acrylate, isotridecyl (meth)acrylate, isostearyl (meth)acrylate, octadecyl (meth)acrylate, 2-octyldecyl (meth)acrylate, dodecyl (meth)acrylate, lauryl (meth) acrylate, and heptadecanyl (meth)acrylate.

In some embodiments, the only monomers in the monomer composition are the first monomer of Formula (I) and the second monomer of Formula (III), Formula (IV), or both. Any suitable amounts of the first monomer and second monomer can be used provided that the monomer composition contains at least 10 weight percent of the first monomer of Formula (I). The addition of a second monomer of Formula (III), Formula (IV), or both tends to increase the hydrophobicity of the porous polymeric particles. The monomer composition often contains 10 to 90 weight percent of the first monomer and 10 to 90 weight percent of the second monomer based on a total weight of monomers in the monomer composition. For example, the second phase can contain 20 to 80 weight percent of the first monomer and 20 to 80 weight percent of the second monomer, 25 to 75 weight percent of the first monomer and 25 to 75 weight percent of the second monomer, 30 to 70 weight percent of the first monomer and 30 to 70 weight percent of the second monomer, or 40 to 60 weight percent of the first monomer and 40 to 60 weight percent of the second monomer based on a total weight of monomers in the monomer composition.

Depending on the final use of the polymeric particles prepared, it can be desirable to include at least one hydrophilic second monomer in the monomer composition. The addition of a hydrophilic second monomer tends to make the polymeric particles more suitable for applications where the particles will be exposed to aqueous-based materials such as aqueous-based samples. Additionally, the use of a hydrophilic second monomer allows the porous polymeric particles to be dispersed in water more easily during the preparation of the porous article using, for example, a wetlaid process. Hydrophilic second monomers are selected so that they are not miscible with the first phase. These monomers may or may not be miscible with the first monomer of Formula (I).

Some example hydrophilic second monomers are hydroxyl-containing monomers of Formula (V).

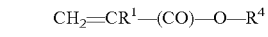

$$CH_2{=}CR^1{-}(CO){-}O{-}R^4 \quad (V)$$

In Formula (V), group $R^1$ is hydrogen or methyl. In many embodiments, $R^1$ is hydrogen. Group $R^4$ is an alkyl substituted with one or more hydroxyl groups or a group of formula $-(CH_2CH_2O)_qCH_2CH_2OH$ where q is an integer equal to at least 1. The alkyl group typically has 1 to 10 carbon atoms, 1 to 6 carbon atoms, 1 to 4 carbon atoms, or 1 to 3 carbon atoms. The number of hydroxyl groups is often in a range of 1 to 3. The variable q is often in a range of 1 to 20, in a range of 1 to 15, in a range of 1 to 10, or in a range of 1 to 5. In many embodiments, the second monomer of Formula (IV) has a single hydroxyl group.

Example monomers of Formula (V) include, but are not limited to, 2-hydroxyethyl (meth)acrylate, 2-hydroxypropyl (meth)acrylate, 3-hydroxypropyl (meth)acrylate, and 4-hydroxybutyl (meth)acrylate), 2-hydroxylbutyl (meth)acrylate, polyethylene glycol mono(meth)acrylate (for example, monomers commercially available from Sartomer (Exton, Pa., USA) under the trade designation CD570, CD571, and CD572), and glycol mono(meth)acrylate.

Other example hydrophilic second monomers are hydroxyl-containing monomers of Formula (VI).

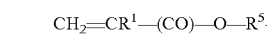

$$CH_2{=}CR^1{-}(CO){-}O{-}R^5{-}O{-}Ar \quad (VI)$$

In Formula (VI), group $R^1$ is hydrogen or methyl. In many embodiments, $R^1$ is hydrogen. Groups $R^5$ is an alkylene substituted with at least one hydroxyl group. Suitable alkylene groups often have 1 to 10 carbon atoms, 1 to 6 carbon atoms or 1 to 4 carbon atoms. The alkylene group $R^5$ can be substituted with 1 to 3 hydroxyl groups but is often substituted with a single hydroxyl group. The group Ar is an aryl group having 6 to 10 carbon atoms. In many embodiments, the Ar group is phenyl. One example monomer of Formula (VI) is 2-hydroxy-2-phenoxypropyl (meth)acrylate.

If the second monomer is of Formula (V) or (VI), which are hydroxyl-containing monomers, the amount of this monomer that can be combined with the first monomer of Formula (I) is often no greater than 2 weight percent based on a total weight of monomers in the monomer composition. If greater than about 2 weight percent of the second monomer of Formula (V) or (VI) is used, the resulting polymeric particles tend to have diminished porosity.

Other hydrophilic monomers can be used as the second monomers in larger quantities than the second monomers of Formula (V) or (VI) without diminishing the porosity of the resulting polymeric particles. For example, sulfonic acid-containing monomers of Formula (VII) can be included in the monomer composition along with the first monomer of Formula (II) or a salt thereof.

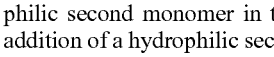

$$CH_2{=}CR^1{-}(CO){-}O{-}R^6{-}SO_3H \quad (VII)$$

In Formula (VII), group $R^1$ is hydrogen or methyl. In many embodiments, $R^1$ is hydrogen. Group $R^6$ is an alkylene having 1 to 10 carbon atoms, 1 to 6 carbon atoms, or 1 to 4 carbon atoms. Examples of sulfonic acid-containing monomers of Formula (VII) include, but are not limited to, sulfoethyl (meth)acrylate and sulfopropyl (meth)acrylate. Depending on the pH conditions, these second monomers can impart an ionic (for example, anionic) character to the porous polymeric particles. The counter ion is often a cation of such as an alkali metal ion, an alkaline earth metal ion, an ammonium ion, or an alkyl substituted ammonium ions such as tetraalkyl ammonium ion.

If the second monomer is a sulfonic acid-containing monomer of Formula (VII), the monomer composition can contain up to 20 weight percent of this monomer based on a total weight of monomers in the monomer composition. In some embodiments, the only monomers in the monomer composition are the first monomer of Formula (I) and the second monomer of Formula (VII). The monomer composition often contains 80 to 99 weight percent of the first monomer of Formula (I) and 1 to 20 weight percent of the second monomer of Formula (VII) based on a total weight of monomers in the monomer composition. For example, the monomer composition can contain 85 to 99 weight percent of the first monomer and 1 to 15 weight percent of the second monomer, 90 to 99 weight percent of the first monomer and 1 to 10 weight percent of the second monomer, and 95 to 99 weight percent of the first monomer and 1 to 5 weight percent of the second monomer based on a total weight of monomers in the monomer composition.

In other embodiments, the monomer composition includes a first monomer of Formula (I) and two second monomers. The two second monomers are a sulfonic acid-containing monomer, such as those of Formula (VII), and a hydroxyl-containing monomer, such as those of Formula (V) or (VI). When the hydroxyl-containing monomer is combined with a sulfonic acid-containing monomer, higher amounts of the hydroxyl-containing monomer can be added to the monomer composition without substantially decreasing the porosity of the resulting polymeric particles. That is, the amount of the hydroxyl-containing monomer can be greater than 2 weight percent based on the weight of the monomers in the monomer composition. The monomer composition often contains 80 to 99 weight percent of the first monomer of Formula (II) and 1 to 20 weight percent of the second monomer, wherein the second monomer is a mixture of the sulfonic acid-containing monomer and the hydroxyl-containing monomer. Up to 50 weight percent, up to 40 weight percent, up to 20 weight percent, or up to 10 weight percent of the second monomer can be the hydroxyl-containing monomer.

Other second monomers that can impart an ionic (for example, anionic) character to the porous polymeric particles have a carboxylic acid group (—COOH). Examples of such monomers include, but are not limited to, (meth)acrylic acid, maleic acid, and 13-carboxyethyl acrylate. If a monomer having a carboxylic acid group is added, this monomer typically is present in an amount no greater than 20 weight percent, no greater than 15 weight percent, no greater than 10 weight percent, or no greater than 5 weight percent based on the total weight of monomers in the monomer composition. For example, the monomer composition often contains 80 to 99 weight percent of the first monomer of Formula (I) and 1 to 20 weight percent of the second monomer having a carboxylic acid group. For example, the monomer composition can contain 85 to 99 weight percent of the first monomer and 1 to 15 weight percent of the second monomer, 90 to 99 weight percent of the first monomer and 1 to 10 weight percent of the second monomer, and 95 to 99 weight percent of the first monomer and 1 to 5 weight percent of the second monomer based on a total weight of monomers in the monomer composition.

Still other hydrophilic monomers are those of Formula (VIII)

$$CH_2{=}CR^1{-}(CO){-}O{-}R^7{-}N(R^8)_3{}^+X^- \quad \text{(VIII)}$$

having a quaternary ammonium group. The group $R^7$ is an alkylene having 1 to 10 carbon atoms, 1 to 6 carbon atoms, or 1 to 4 carbon atoms. The group $R^8$ is an alkyl having 1 to 4 carbon atoms or 1 to 3 carbon atoms. The anion $X^-$ can be any anion but is often a halide such as chloride. Alternatively the anion can be a sulfate and be associated with two ammonium-containing cationic monomers. Examples include, but are not limited to, (meth)acrylamidoalkyltrimethylammonium salts (for example, 3-methacrylamidopropyltrimethylammonium chloride and 3-acrylamidopropyltrimethylammonium chloride) and (meth) acryloxyalkyltrimethylammonium salts (for example, 2-acryloxyethyltrimethylammonium chloride, 2-methacryloxyethyltrimethylammonium chloride, 3-methacryloxy-2-hydroxypropyltrimethylammonium chloride, 3-acryloxy-2-hydroxypropyltrimethylammonium chloride, and 2-acryloxyethyltrimethylammonium methyl sulfate). Depending on the pH conditions, these third monomers can impart an ionic (for example, cationic) character to the porous polymeric particles.

If a second monomer of Formula (VIII) is added, this monomer typically is present in an amount no greater than 20 weight percent, no greater than 15 weight percent, no greater than 10 weight percent, or no greater than 5 weight percent based on the total weight of monomers in the monomer composition. For example, the monomer composition often contains 80 to 99 weight percent of the first monomer of Formula (I) and 1 to 20 weight percent of the second monomer of Formula (VIII). For example, the monomer composition can contain 85 to 99 weight percent of the first monomer and 1 to 15 weight percent of the second monomer, 90 to 99 weight percent of the first monomer and 1 to 10 weight percent of the second monomer, and 95 to 99 weight percent of the first monomer and 1 to 5 weight percent of the second monomer based on a total weight of monomers in the monomer composition.

Often if an ionic monomer is added such as one having a carboxylic acid group or a salt thereof, a sulfonic acid group or a salt thereof (such as of Formula (VII)), or an ammonia group (such as of Formula (VIII)), the ionic monomer is often present in low amounts such as in a range of 1 to 10 weight percent, in a range of 1 to 5 weight percent, or in a range of 1 to 3 percent based on the total weight of monomers in the monomer composition. Particularly when the preparation of porous polymeric particles having an average diameter less than about 10 micrometers, less than about 5 micrometers, less than about 4 micrometers, or less than about 3 micrometers are desired, lower concentrations of the ionic monomers in the monomer composition may be preferred. For use with hydrophobic materials or nonionic materials, it may be preferable to have monomer compositions that are free or substantially free of ionic monomers. As used herein in reference to the amount of ionic monomers, "substantially free" means that no such monomer is intentionally added or is added at an amount no greater than 1 weight percent, no greater than 0.5 weight percent, no greater than 0.2 weight percent, or no greater than 0.1 weight percent based on the total weight of monomers in the monomer composition.

In some embodiments, it is preferable that the monomer composition contains only a monomer of Formula (I) or a mixture of a first monomer of Formula (I) and a second monomer of Formula (III) added to increase the hydrophobicity of the porous polymeric particles. For example, some monomer compositions often contains 10 to 90 weight percent of the first monomer and 10 to 90 weight percent of the second monomer based on a total weight of monomers in the monomer composition. For example, the monomer composition can contain 20 to 80 weight percent of the first monomer and 20 to 80 weight percent of the second monomer, 25 to 75 weight percent of the first monomer and 25 to 75 weight percent of the second monomer, 30 to 70 weight percent of the first monomer and 30 to 70 weight percent of the second monomer, or 40 to 60 weight percent of the first monomer and 40 to 60 weight percent of the second monomer.

The monomer composition can optionally contain a third monomer with at least two polymerizable groups. The polymerizable groups are typically (meth)acryloyl groups. In many embodiments, the third monomer has two or three (meth)acryloyl groups. The third monomer typically is not miscible with the first phase and may or may not be miscible with the first monomer of Formula (I).

Some third monomers have a hydroxyl group. Such monomers can function as crosslinkers like the first monomer of Formula (I) but can provide polymeric particles with increased hydrophilic character. An example hydroxyl-containing third monomer is glycerol di(meth)acrylate.

Some third monomers are selected to have at least three polymerizable groups. Such third monomers can be added to provide more rigidity to the resulting polymeric particles. The addition of these third monomers tends to minimize swelling of the polymeric particles when exposed to water. Suitable third monomers include, but are not limited to, ethoxylated trimethylolpropane tri(meth)acrylates such as ethoxylated (15) trimethylolpropane triacrylate (commercially available under the trade designation SR9035 from Sartomer) and ethoxylated (20) trimethylolpropane triacrylate (commercially available under the trade designation SR415 from Sartomer); propoxylated trimethylolpropane tri(meth)acrylates such as propoxylated (3) trimethylolpropane triacrylate (commercially available under the trade designation SR492 from Sartomer) and propoxylated (6) trimethylolpropane triacrylate (commercially available under the trade designation CD501 from Sartomer); tris(2-hydroxyethyl) isocyanurate tri(meth)acrylates such as tris (2-hydroxyethyl) isocyanurate triacrylate (commercially available under the trade designations SR368 and SR368D from Sartomer); and propoxylated glyceryl tri(meth)acrylates such as propoxylated (3) glycerol triacrylate (commercially available under the trade designation SR9020 and SR9020HP from Sartomer).

When a third monomer is present in the monomer composition, any suitable amount can be used. The third monomer is often used in an amount up to 20 weight percent based on the total weight of monomers in the monomer composition. In some embodiments, the amount of the third monomer is up to 15 weight percent, up to 10 weight percent, or up to 5 weight percent.

In some embodiments, the monomer composition contains at least 10 weight percent, at least 20 weight percent, at least 30 weight percent, at least 35 weight percent, at least 40 weight percent, at last 45 weight percent, at least 50 weight percent, at least 55 weight percent, at least 60 weight percent, at least 65 weight percent, at least 70 weight percent, at least 75 weight percent at least 80 weight percent, at least 90 weight percent, or at least 95 weight percent of the first monomer of Formula (I). The remaining amount of the monomer composition can include any combination of the second and third monomers described above. In some embodiments, any remaining amount is a monomer of Formula (III).

The monomer composition often contains 10 to 100 weight percent of the first monomer, 0 to 90 weight percent of the second monomer, and 0 to 20 weight percent of the third monomer based on a total weight of monomers in the monomer composition. For example, the monomer composition can contain 10 to 90 weight percent of the first monomer, 10 to 90 weight percent of the second monomer, and 0 to 20 weight percent of the third monomer. The monomer composition can contain 10 to 89 weight percent of the first monomer, 10 to 89 weight percent of the second monomer, and 1 to 20 weight percent of the third monomer based on a total weight of the monomer composition.

In addition to the monomer composition, the second phase contains poly(propylene glycol), which functions as a porogen. The poly(propylene glycol) is soluble in the monomer composition within the second phase but is dispersible within the first phase. Stated differently, the poly(propylene glycol) is completely miscible with the second phase and partially miscible with the first phase. The poly(propylene glycol) is removed after polymerization of the monomer composition to provide pores (for example, void volumes or free volumes) in the polymeric particle. The poly(propylene glycol) does not have any polymerizable groups (i.e., it is not a monomer) and, in general, is not covalently attached to the polymeric particles that forms within the second phase. It is believed that some of the poly(propylene glycol) become entrained within the polymerized product. It is further believed that some of the poly(propylene glycol) is positioned on the interface between the first phase and the second phase as the polymerized product is formed in the second phase. The presence of the poly(propylene glycol) at the surface of the forming polymerized product results in the formation of a polymeric particle having surface porosity. The surface porosity can be seen from electron micrographs of the polymeric particles such as in FIG. 1.

The second phase can contain up to 50 weight percent poly(propylene glycol). If higher amounts of the poly(propylene glycol) are used, there may be an insufficient amount of the monomer composition included in the second phase to form polymeric particles that are uniformly shaped. In many embodiments, the second phase can contain up to 45 weight percent, up to 40 weight percent, up to 35 weight percent, up to 30 weight percent, or up to 25 weight percent poly (propylene glycol) based on a total weight of the second phase. The second phase typically contains at least 5 weight percent poly(propylene glycol). If lower amounts of the poly(propylene glycol) are used, the porosity of the resulting polymeric particles may be insufficient. The second phase typically can contain at least 10 weight percent, at least 15 weight percent, or at least 20 weight percent poly(propylene glycol). In some embodiments, the second phase contains 5 to 50 weight percent, 10 to 50 weight percent, 10 to 40 weight percent, 10 to 30 weight percent, 20 to 50 weight percent, 20 to 40 weight percent, or 25 to 35 weight percent poly(propylene glycol) based on the total weight of the second phase.

In some embodiments, the second phase contains 50 to 90 weight percent monomer composition and 10 to 50 weight percent poly(propylene glycol), 60 to 90 weight percent monomer composition and 10 to 40 weight percent poly (propylene glycol), 50 to 80 weight percent monomer composition and 20 to 50 weight percent poly(propylene glycol), or 60 to 80 weight percent monomer composition and 20 to 40 weight percent poly(propylene glycol) based on a total weight of the second phase.

In addition to the monomer composition and poly(propylene glycol), the second phase often contains an initiator for free radical polymerization of the monomer composition. Any suitable initiator known in the art can be used. The initiator can be a thermal initiator, a photoinitiator, or both. The specific initiator used is often selected based on its solubility in the second phase. The initiator is often used at a concentration of 0.1 to 5 weight percent, 0.1 to 3 weight percent, 0.1 to 2 weight percent, or 0.1 to 1 weight percent based on the weight of monomers in the monomer composition.

When a thermal initiator is added to the reaction mixture, polymeric particles can be formed at room temperature (i.e., 20 to 25 degrees Celsius) or at an elevated temperature. The temperature needed for polymerization often depends on the particular thermal initiator used. Examples of thermal initiators include organic peroxides and azo compounds.

When a photoinitiator is added to the reaction mixture, polymeric particles can be formed by the application of actinic radiation. Suitable actinic radiation includes electromagnetic radiation in the infrared region, visible region, ultraviolet region, or a combination thereof.

Examples of photoinitiators suitable in the ultraviolet region include, but are not limited to, benzoin, benzoin alkyl ethers (for example, benzoin methyl ether and substituted benzoin alkyl ethers such anisoin methyl ether), phenones (for example, substituted acetophenones such as 2,2-dimethoxy-2-phenylacetophenone and substituted alpha-ketols such as 2-methyl-2-hydroxypropiophenone), phosphine oxides, polymeric photoinitiators, and the like.

Commercially available photoinitiators include, but are not limited to, 2-hydroxy-2-methyl-1-phenyl-propane-1-one (for example, commercially available under the trade designation DAROCUR 1173 from Ciba Specialty Chemicals), a mixture of 2,4,6-trimethylbenzoyl-diphenyl-phosphine oxide and 2-hydroxy-2-methyl-1-phenyl-propan-1-one (for example, commercially available under the trade designation DAROCUR 4265 from Ciba Specialty Chemicals), 2,2-dimethoxy-1,2-diphenylethan-l-one (for example, commercially available under the trade designation IRGACURE 651 from Ciba Specialty Chemicals), a mixture of bis(2,6-dimethoxybenzoyl)-2,4,4-trimethyl-pentylphosphine oxide and 1-hydroxy-cyclohexyl-phenyl-ketone (for example, commercially available under the trade designation IRGACURE 1800 from Ciba Specialty Chemicals), a mixture of bis(2,6-dimethoxybenzoyl)-2,4,4-trimethyl-pentylphosphine oxide (for example, commercially available under the trade designation IRGACURE 1700 from Ciba Specialty Chemicals), 2-methyl-1[4-(methylthio)phenyl]-2-morpholinopropan-1-one (for example, commercially available under the trade designation IRGACURE 907 from Ciba Specialty Chemicals), 1-hydroxy-cyclohexyl-phenyl-ketone (for example, commercially available under the trade designation IRGACURE 184 from Ciba Specialty Chemicals), 2-benzyl-2-(dimethylamino)-1-[4-(4-morpholinyl)phenyl]-1-butanone (for example, commercially available under the trade designation IRGACURE 369 from Ciba Specialty Chemicals), bis(2,4,6-trimethylbenzoyl)-phenylphosphine oxide (for example, commercially available under the trade designation IRGACURE 819 from Ciba Specialty Chemicals), ethyl 2,4,6-trimethylbenzoyldiphenyl phosphinate (for example, commercially available from BASF, Charlotte, N.C. under the trade designation LUCIRIN TPO-L), and 2,4,6-trimethylbenzoyldiphenylphosphine oxide (for example, commercially available from BASF, Charlotte, N.C. under the trade designation LUCIRIN TPO).

The reaction mixture often includes at least 5 weight percent of the second phase (dispersed phase) and up to 95 weight percent of the first phase (continuous phase). In some embodiments, the reaction mixture contains 5 to 40 weight percent second phase and 60 to 95 weight percent first phase, 5 to 30 weight percent second phase and 70 to 95 weight percent first phase, 10 to 30 weight percent second phase and 70 to 90 weight percent first phase, or 5 to 20 weight percent second phase and 80 to 95 weight percent first phase. The weight percents are based on a total weight of the reaction mixture.

To prepare the polymeric particles or beads, droplets of the second phase are formed in the first phase. The components of the second phase are often mixed together prior to addition to the first phase. For example, the monomer composition, initiator, and the poly(propylene glycol) can be blended together and then this blended composition, which is the second phase, can be added to the first phase. The resulting reaction mixture is often mixed under high shear to form a micro-emulsion. The size of the dispersed second phase droplets can be controlled by the amount of shear or the mixing rate. The size of the droplets can be determined by placing a sample of the mixture under an optical microscope prior to polymerization. Although any desired droplet size can be used, the average droplet diameter is often less than 500 micrometers, less than 200 micrometers, less than 100 micrometers, less than 50 micrometers, less than 25 micrometers, less than 10 micrometers, or less than 5 micrometers. For example, the average droplet diameter can be in the range of 1 to 500 micrometers, 1 to 200 micrometers, 1 to 100 micrometers, 5 to 100 micrometers, 5 to 50 micrometers, 5 to 25 micrometers, or 5 to 10 micrometers.

If a photoinitiator is used, the reaction mixture is often spread on a non-reactive surface at a thickness that can be penetrated by the desired actinic radiation. The reaction mixture is spread using methods that do not cause the droplets to coalesce. For example, the reaction mixture can be formed using an extrusion method. Often, the actinic radiation is in the ultraviolet region of the electromagnetic spectrum. If the ultraviolet radiation is applied from only the top surface of the reaction mixture layer, the thickness of the layer can be up to about 10 millimeters. If the reaction mixture layer is exposed to ultraviolet radiation from both the top and bottom surfaces, the thickness can be greater such as up to about 20 millimeters. The reaction mixture is subjected to the actinic radiation for a time sufficient to react the monomer composition and form polymeric particles. The reaction mixture layer is often polymerized within 5 minutes, within 10 minutes, within 20 minutes, within 30 minutes, within 45 minutes, or within 1 hour depending on the intensity of the actinic radiation source and the thickness of the reaction mixture layer.

If a thermal initiator is used, the droplets can be polymerized while continuing to mix the reaction mixture. Alternatively, the reaction mixture can be spread on a non-reactive surface to any desired thickness. The reaction mixture layer can be heated from the top surface, from the bottom surface, or both to form the polymeric particles. The thickness is often selected to be comparable to that use with the use of actinic radiation such as ultraviolet radiation.

In many embodiments, a photoinitiator is preferred over a thermal initiator because lower temperatures can be used for polymerization. That is, the use of actinic radiation such as ultraviolet radiation can be used to minimize degradation of various components of the reaction mixture that might be sensitive to temperatures needed for use with thermal initiators. Further, the temperatures typically associated with the use of thermal initiators may undesirably alter the solubility of the various components of the reaction mixture between the first phase and the dispersed second phase.

During the polymerization reaction, the monomer composition reacts within the second phase droplets suspended in the first phase. As polymerization progresses, the poly (propylene glycol) included in the second phase gets partially entrained within the polymerized product. Although it is possible that some portion of the poly(propylene glycol) can be covalently attached to the polymeric product through a chain transfer reaction, preferably the poly(propylene glycol) is not bonded to the polymeric product. The polymerized product is in the form of particles. In some embodiments, the particles are polymeric beads having a relatively uniform size and shape.

After formation of the polymerized product (i.e., polymeric particles containing entrained poly(propylene glycol)), the polymerized product can be separated from the first phase. Any suitable separation method can be used. For example, water is often added to lower the viscosity of the first phase. Particles of the polymerized product can be separated from the other components by decantation, filtration, or centrifugation. The particles of the polymerized product can be further washed by suspending them in water and collecting them a second time by decantation, filtration, or centrifugation.

The particles of the polymerized product can then be subjected to one or more washing steps to remove the poly(propylene glycol) porogen. Suitable solvents for removing the poly(propylene glycol) include, for example, acetone, methyl ethyl ketone, toluene, and alcohols such as ethanol, n-propanol, or iso-propanol. Stated differently, the entrained poly(propylene glycol) is removed from the polymerized product using solvent extraction methods. Pores are created where the poly(propylene glycol) previously resided.

In many embodiments, the resulting porous polymeric particles (the polymerized product after removal of the poly(propylene glycol) porogen) have an average diameter that is less than 500 micrometers, less than 200 micrometers, less than 100 micrometers, less than 50 micrometers, less than 25 micrometers, less than 10 micrometers, or less than 5 micrometers. For example, the porous polymeric particles can have an average diameter in the range of 1 to 500 micrometers, 1 to 200 micrometers, 1 to 100 micrometers, 1 to 50 micrometers, 1 to 25 micrometers, 1 to 10 micrometers, or 1 to 5 micrometers. The particles are often in the form of beads.

The polymeric particles usually have multiple pores distributed over the surface of the particles. In some embodiments, the polymeric particles are hollow in addition to having multiple pores distributed over the surface of the particles. After removal of the poly(propylene glycol) porogen, the resulting polymeric particles tend to be more porous than polymeric particles prepared using a first phase that is predominately water.

The porous article includes the porous polymeric particles bound to a fibrous substrate. The fibrous substrate can be either woven or nonwoven. In many embodiments, the porous article includes porous polymeric particles bound to a nonwoven, fibrous substrate. The nonwoven, fibrous substrate is often in the form of a layer of interlaid fibers that are not woven or knitted together. The nonwoven, fibrous substrate can be prepared by any suitable process such as, for example, air laying techniques, spunlaid techniques such as meltblown or spunbonding, carding, and combinations thereof. In some applications, it may be preferable to prepare the fibrous substrate by meltblown techniques.

Fibers suitable for use in preparing the nonwoven, fibrous porous matrix are usually pulpable or extrudable fibers such as those that are stable to radiation and/or to a variety of solvents. Useful fibers typically include polymeric fibers. In many embodiments, the fibers include polymeric fibers, such as one or a plurality of different types of polymeric fibers. For example, at least some of the polymeric fibers can be selected to exhibit a degree of hydrophilicity. In certain embodiments, the fibers include blown melt fibers.

Suitable polymeric fibers include those made from natural polymers (those derived from animal or vegetable sources) and/or synthetic polymers, including thermoplastic and solvent-dispersible polymers. Useful polymers include polyesters (for example, polyethylene terephthalate, polybutylene terephthalate, and polyester elastomers (e.g., those available under the trade designation HYTREL from E. I. DuPont de Nemours & Co.)); polyamides (for example, nylon 6, nylon 6,6, nylon 6,12, poly(iminoadipoyliminohexamethylene), poly(iminoadipoyliminodecamethylene), polycaprolactam, and the like); polyurethanes (for example, ester-based polyurethanes and ether-based polyurethanes); polyolefins (for example, polyethylene, polypropylene, polybutylene, copolymers of ethylene and propylene, alpha olefin copolymers such as copolymers of ethylene or propylene with 1-butene, 1-hexene, 1-octene, and 1-decene such as poly(ethylene-co-1-butene), poly(ethylene-co-1-butene-co-1-hexene), and the like); rubber elastomers such as a natural rubber (for example, polyisoprene) or a synthetic elastomer such as neoprene, butyl rubber, nitrile rubber, or silicone rubber; fluorinated polymers (for example, poly(vinyl fluoride), poly(vinylidene fluoride), copolymers of vinylidene fluoride such as poly(vinylidene fluoride-co-hexafluoropropylene), copolymers of chlorotrifluoroethylene such as poly(ethylene-co-chlorotrifluoroethylene), and the like); chlorinated polymers; poly(butadienes); polyimides (for example, poly(pyromellitimide) and the like); polyethers; poly(ether sulfones) (for example, poly(diphenylether sulfone), poly(diphenylsulfone-co-diphenylene oxide sulfone), and the like); poly(sulfones); poly(vinyl esters) such as poly(vinyl acetates); copolymers of vinyl acetate (for example, poly(ethylene-co-vinyl acetate), copolymers in which at least some of the acetate groups have been hydrolyzed to provide various poly(vinyl alcohols) including poly(ethylene-co-vinyl alcohol), and the like); poly(phosphazenes); poly(vinyl ethers); poly(vinyl alcohols); poly(carbonates); and the like; and combinations thereof.

In certain embodiments, one type of polymeric fiber is used, such as a polyester elastomer. In some embodiments, mixtures of hydrophobic and hydrophilic polymeric fibers are used. For example, the fibrous porous matrix can include a mixture of hydrophilic fibers such as polyamides plus hydrophobic fibers such as polyolefins. Further, suitable fibers for the fibrous porous matrix can include coextruded fibers such as layered fibers, fibers having a core-sheath structure, a side-by-side structure, an islands-in-the-sea structure, or a segmented-pie structure, or other types known to those skilled in the art.

The fibers used to form a fibrous substrate can be of a length and a diameter that can provide a porous substrate having structural integrity and porosity, such as for a fluid management application. The fiber lengths are often at least about 10 millimeters, at least 15 millimeters, at least 20 millimeters, at least 25 millimeters, at least 30 millimeters, at least 50 millimeters, or at least 75 millimeters. The diameter of the fibers can be, for example, at least 1 micrometer, at least 2 micrometers, at least 5 micrometers, at least 10 micrometers, at least 20 micrometers, at least 40 micrometers, and up to 12 micrometers, up to 25 micrometers, up to 35 micrometers, up to 50 micrometers, or up to 75 micrometers. The fiber lengths and diameters will vary depending upon factors such as the nature of the fiber and the type of application.

The fibrous substrate can contain a plurality of different types of fibers. In some embodiments, the substrate can be formed using two, three, four, or even more different types of fibers. For example, a nylon fiber can be added for strength and integrity and hydrophilic character, while polyethylene fibers provide hydrophobic character to the substrate.

The fibrous substrate often further contains at least one polymeric binder or adhesive. Suitable polymeric binders and adhesives include natural and synthetic polymeric materials that are relatively inert (exhibiting little or no chemical interaction with either the fibers or the porous polymeric particles). Useful polymeric binders and adhesives include polymeric resins (for example, in the form of powders and latexes). Suitable polymeric resins for use in the fibrous substrate include, but are not limited to, natural rubbers, neoprene, styrene-butadiene copolymers, acrylate resins, polyvinyl chloride, polyvinyl acetate, and combinations thereof. In many embodiments, the polymeric resin includes acrylate resins.

In certain embodiments, the fibrous substrate contains only fibers. In certain alternate embodiments, the fibrous substrate contains only fibers and binder or adhesive. For example, at least 90 weight percent, at least 95 weight percent, at least 98 weight percent, at least 99 weight percent, or at least 99.5 weight percent of a dry fibrous substrate is either fibers or binder/adhesive.

The article includes both the fibrous substrate and porous polymeric particles bound to the fibrous substrate. In most embodiments, the article contains at least 5 weight percent porous polymeric particles based on a total dry weight of the article. If the amount of the porous polymeric particles is lower than about 5 weight percent, the article may not contain enough porous polymeric particles to effectively manage fluids. In some examples, the porous article contains at least 10 weight percent, at least 15 weight percent, at least 20 weight percent, at least 30 weight percent, at least 40 weight percent, at least 50 weight percent, at least 60 weight percent, at least 70 weight percent, or at least 80 weight percent porous polymeric particles based on a total dry weight of the porous article.

On the other hand, the article usually contains no greater than 90 weight percent porous polymeric particles based on the total dry weight of the article. If the amount of the porous polymeric particles is greater than about 90 weight percent, the porous article may contain an insufficient amount of the fibrous substrate. That is, the strength of the porous article may be insufficient to hold together when contacted with a fluid. In some examples, the article contains no greater than 85 weight percent, no greater than 75 weight percent, no greater than 65 weight percent, no greater than 55 weight percent, no greater than 45 weight percent, no greater than 35 weight percent, or no greater than 25 weight percent porous polymeric particles based on a total weight of the porous article.

Stated differently, the article often contains 5 to 90 weight percent porous polymeric particles and 10 to 95 weight percent fibrous substrate, 15 to 90 weight percent porous polymeric particles and 10 to 85 weight percent fibrous substrate, 20 to 70 weight percent porous polymeric particles and 30 to 80 weight percent fibrous substrate, 20 to 60 weight percent porous polymeric particles and 40 to 80 weight percent fibrous substrate, 25 to 50 weight percent porous polymeric particles and 40 to 75 weight percent fibrous substrate, or 30 to 60 weight percent porous polymeric particles and 40 to 70 weight percent fibrous substrate. In an embodiment, the article contains 15 to 57 weight percent porous polymeric particles and 43 to 85 weight percent fibrous substrate. The amounts are based on the total dry weight of the article.

In many embodiments, the article (when dry) contains only porous polymeric particles and fibrous substrate. For example, the article contains at least 90 weight percent, at least 95 weight percent, at least 98 weight percent, at least 99 weight percent, or at least 99.5 weight percent combined porous polymeric particles and fibrous substrate when dry. In certain embodiments, the article (when dry) contains only porous polymeric particles, fibrous substrate, and binder and/or adhesive. For example, the article contains at least 90 weight percent, at least 95 weight percent, at least 98 weight percent, at least 99 weight percent, or at least 99.5 weight percent combined porous polymeric particles, fibrous substrate, and bind and/or adhesive, when dry. Preferably, any polymeric binder included in the fibrous substrate adheres the porous polymeric particles to the fibrous substrate in the article. In select embodiments, the article further includes an active agent adsorbed within at least some of the porous polymeric particles.

The porous polymeric particles or the hollow and porous polymeric particles are well suited for storage and delivery of an active agent. That is, in certain embodiments, the porous polymeric particles further include an active agent. In particular, if all of the monomers in the monomer composition are hydrophobic, the polymeric particles tend to be hydrophobic (i.e., hydrophobic polymeric particles) and can accept (e.g., be loaded with) hydrophobic active agents. If some of the monomers in the monomer composition are hydrophilic, however, the polymeric particles tend to have sufficient hydrophilic character (i.e., hydrophilic polymeric particles) to accept hydrophilic active agents. Further, if the monomer composition includes a mixture of both hydrophobic monomers and hydrophilic monomers, the porous polymeric particles tend to have sufficient hydrophobic and hydrophilic character to accept both hydrophobic and hydrophilic active agents. In some embodiments, polymeric particles having both hydrophobic and hydrophilic character can be desirable.

Some active agents of particular interest are biologically active agents. As used herein, the term "biologically active agent" refers to a compound that has some known effect on living systems such as, for example, a bacteria or other microorganism, plant, fish, insect, or mammal. The bioactive agent is added for the purpose of affecting the living system such as affecting the metabolism of the living system. Examples of biologically active agents include, but are not limited to, medicaments, herbicides, insecticides, antimicrobial agents, disinfectants and antiseptic agents, local anesthetics, astringents, antifungal agents (i.e., fungicides), antibacterial agents, growth factors, herbal extracts, antioxidants, steroids or other anti-inflammatory agents, compounds that promote wound healing, vascodilators, exfoliants, enzymes, proteins, carbohydrates, silver salts, and the like. Any other suitable biologically active agent known in the art can be used. In some particular embodiments, the active agent is an antimicrobial agent.

Any suitable method can be used to load (i.e., to position) the active agent into the porous polymeric particle once the porogen has been removed. In some embodiments, the active agent is a liquid and the polymeric particles are mixed with the liquid to load the active agent. In other embodiments, the active agent can be dissolved in a suitable organic solvent or water and the polymeric particles are exposed to the resulting solution. Any organic solvent that is used is typically selected so that it does not dissolve the polymeric particles. When an organic solvent or water is used, at least some of the organic solvent or water may be loaded by the polymeric particle in addition to the active agent.

When the active agent is dissolved in an organic solvent or water, the concentration is typically selected to be as great as possible to shorten the time needed for loading of a suitable amount of the active agent onto the porous polymeric particle. The amount of active agent loaded and the amount of time required for loading are often dependent, for example, on the composition of the monomers used to form the polymeric particle, the rigidity of the polymeric particle (e.g., the amount of crosslinking), and the compatibility of the active agent with the polymeric particle. The loading time is often less than 24 hours, less than 18 hours, less than 12 hours, less than 8 hours, less than 4 hours, less than 2 hours, less than 1 hour, less than 30 minutes, less than 15 minutes, or less than 5 minutes. After loading, the particles are typically separated from the solution containing the active agent by decantation, filtration, centrifugation, or drying.

The volume of active agent loaded can be up to the volume of poly(propylene glycol) removed from the polymerized product used to form the porous polymeric particles. That is, the active agent can fill the voids left after removal of the poly(propylene glycol). In many embodiments, the amount of active agent loaded can be up to 50 weight percent based on a total weight of the polymeric particle after loading (i.e., porous polymeric particles plus the loaded active agent). In some example loaded polymeric particles, the amount of the active agent can be up to 40 weight percent, up to 30 weight percent, up to 25 weight percent, up to 20 weight percent, up to 15 weight percent, up to 10 weight percent, or up to 5 weight percent. The amount of active agent is typically at least 0.1 weight percent, at least 0.2 weight percent, at least 0.5 weight percent, at least 1 weight percent, at least 5 weight percent, or at least 10 weight percent. Some loaded porous polymeric particles contain 0.1 to 50 weight percent, 0.5 to 50 weight percent, 1 to 50 weight percent, 5 to 50 weight percent, 1 to 40 weight percent, 5 to 40 weight percent, 10 to 40 weight percent, or 20 to 40 weight percent active agent. Because the porous polymeric particles tend to be highly crosslinked, they tend to swell little even after loading of the active agent. That is, the average sizes of the porous polymeric particles are comparable before and after loading of the active agent.

The active agent is not covalently bonded to the polymeric particles. Under suitable diffusion controlled conditions, the active agent can be released (i.e., delivered) from the polymeric particles. The release can be complete or nearly complete (e.g., greater than 90 percent, greater than 95 percent, greater than 98 percent, greater than 99 percent complete).

In most embodiments, the polymeric particles that are prepared using a second monomer or third monomer that is hydrophilic can be used as a moisture management material. That is, these hydrophilic porous polymeric particles can be used to control moisture (e.g., to adsorb moisture). As used herein, the term "moisture" refers to water or to a water-containing solution. Applications include, but are not limited to, adsorption of wound fluids in wound dressing articles, adsorption of sweat in sweat management articles, and adsorption of urine in incontinence management articles. The hydrophilic polymeric particles can be used to both manage moisture and to deliver a hydrophilic active agent. For example, hydrophilic polymeric particles can be used in a wound dressing to both manage water and to deliver a hydrophilic antimicrobial agent.

The polymeric particles are not tacky. This makes them well suited for applications where the particles are included in a layer of an article that is positioned adjacent to skin. Additionally, because the polymeric particles tend to be highly crosslinked, they tend to swell little even when an active agent is loaded or moisture is adsorbed. That is, the polymeric particles undergo a relatively small change in volume when an active agent is loaded or moisture is adsorbed.

Advantageously, the article comprising a fibrous substrate and porous polymeric particles bound to the fibrous substrate tends not to swell when fluid is absorbed. For instance, upon immersion in water for 1 hour, the article does not expand in length in any direction. The article further provides enhanced wicking and evaporation abilities as compared to the fibrous substrate without porous polymeric particles bound to the fibrous substrate. This is discussed in the Examples below. Without wishing to be bound by theory, it believed that the spherical shape and tortuosity of surface of the porous polymeric particles result in a structure that not only breaks the surface tension of many fluids but also results in an increased capillary action that facilitates the transport of fluids throughout the article. The combined effect of the action of the morphology of the particles and their placement in the fibrous substrate results in much higher wicking and evaporation rates than other fibrous substrates.

In a second aspect, a method of making a porous article is provided. The method includes a) providing porous polymeric particles; b) providing a fibrous substrate comprising fibers; and c) binding the porous polymeric particles to the fibrous substrate. At least 50% of the porous polymeric particles are bound to the fibrous substrate. The porous polymeric particles comprise a polymerized product of a reaction mixture comprising i) a monomer composition comprising at least 10 weight percent of a first monomer of Formula (I) based on a total weight of the monomer composition; and ii) a poly(propylene glycol) having a weight average molecular weight of at least 500 grams/mole.

$$CH_2{=}C(R^1){-}(CO){-}O[{-}CH_2{-}CH_2{-}O]_p{-}(CO){-}C(R^1){=}CH_2 \quad (I)$$

In Formula (I), p is an integer equal to at least 1 and $R^1$ is hydrogen or alkyl. The poly(propylene glycol) is removed from the polymerized product to provide the porous polymeric particles.

Figure 6:
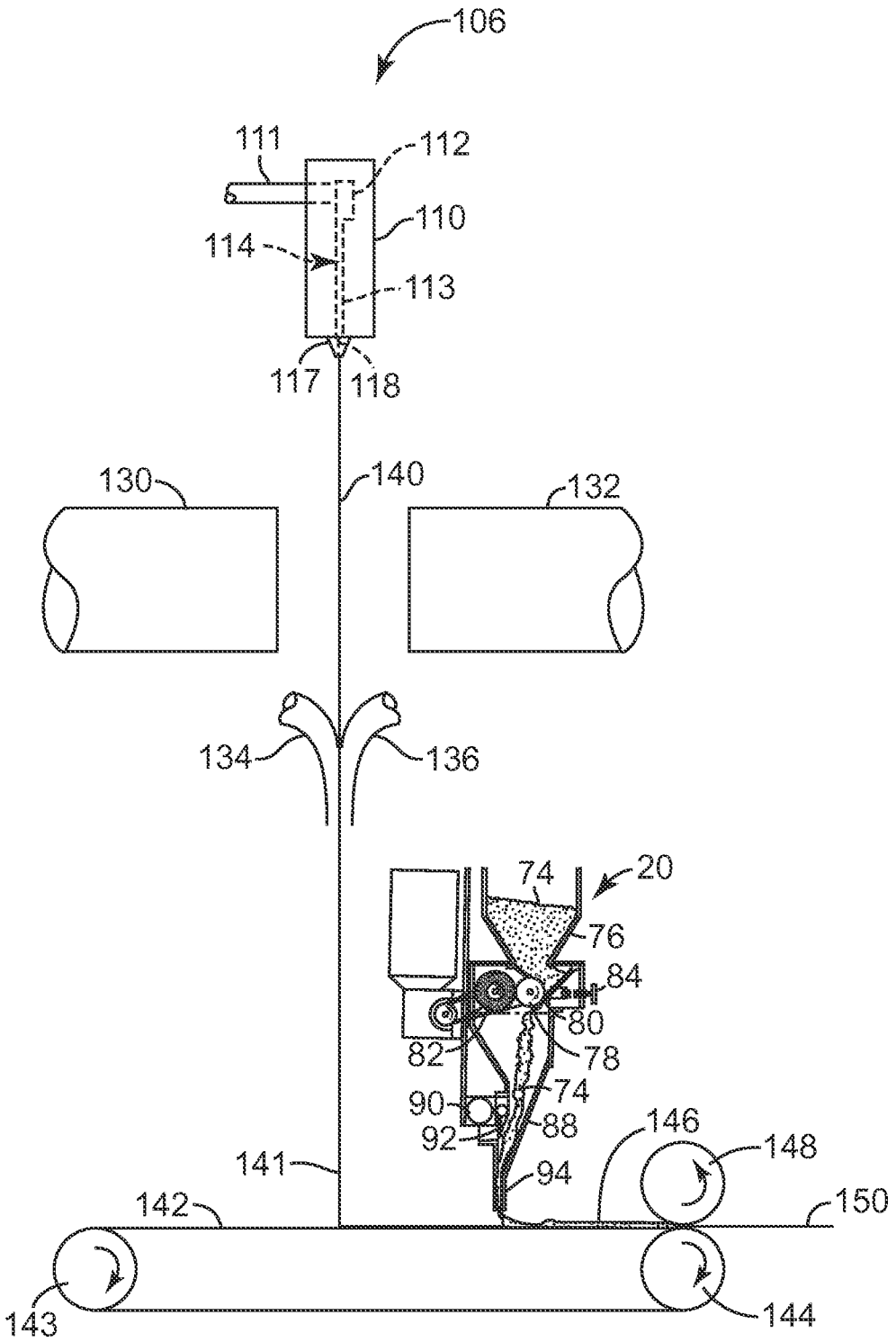
FIG. 6 is a schematic of an experimental setup for preparing porous articles.

In certain embodiments, binding porous polymeric particles to the fibrous substrate comprises i) heating the fibrous substrate to a temperature above the glass transition temperature of the fibers; ii) contacting the porous polymeric particles with the heated fibrous substrate; and iii) cooling the porous polymeric particles and fibrous substrate to fuse porous polymeric particles to the fibrous substrate. In such embodiments, the fibrous substrate is made by any suitable method known to the skilled practitioner (for example, air laying techniques, spunlaid techniques such as meltblown or spunbonding, carding, and the like). An advantage of this method is that porous polymeric particles can be bound to any available fibrous substrate, and without requiring binders and/or adhesives. In an embodiment, the fibrous substrate comprises fibers having a lower glass transition temperature than the degradation temperature of the porous polymeric particles. Selecting such fibers will minimize the likelihood of damaging the porous polymer particles when they are brought into contact with the heated fibers. Referring to FIG. 6, one suitable apparatus 106 is illustrated for making a porous article using a spun bond process. Molten fiber-forming polymeric material enters generally vertical nonwoven die 110 via inlet 111, flows downward through manifold 112 and die slot 113 of die cavity 114 (all shown in phantom), and exits die cavity 114 through orifices such as orifice 118 in die tip 117 as a series of downwardly-extending filaments 140. A quenching fluid (typically air) conducted via ducts 130 and 132 solidifies at least the surfaces of the filaments 140. The at least partially solidified filaments 140 are drawn toward collector 142 while being attenuated into fibers 141 by generally opposing streams of attenuating fluid (typically air) supplied under pressure via ducts 134 and 136. Meanwhile, referring to the apparatus 20, sorbent particles 74 pass through hopper 76 past feed roll 78 and doctor blade 80, which is adjusted with doctor blade adjustment 84. A stream of particles 74 is directed through nozzle 94 amidst fibers 141. The mixture of particles 74 and fibers 141 lands against porous collector 142 carried on rollers 143 and 144 and forms a self-supporting nonwoven particle-loaded spun bond web 146. Calendaring roll 148 opposite roll 144 compresses and point-bonds the fibers in web 146 to produce the porous article 150, which is a calendared spun bond nonwoven particle-loaded web. Alternatively, the spunbond web can be bonded using a through air bonder approach, or using a smooth or patterned calendar roll. Further details regarding the manner in which spun bonding would be carried out using such an apparatus will be familiar to those skilled in the art.

In certain embodiments, binding porous polymeric particles to a fibrous substrate is performed simultaneously with the providing of a fibrous substrate. In one specific method, the article is prepared using a meltblown process. The meltblown process includes flowing molten polymer through a plurality of orifices to form filaments; attenuating the filaments into fibers; directing a stream of porous polymeric particles amidst the filaments or fibers; and collecting the fibers and porous polymeric particles particles as a nonwoven web to form an article. The meltblown fibers and the porous polymeric particles are optionally collected on a vacuum collection drum roll. In one embodiment, the method further comprises compressing the nonwoven web by calendaring, heating, or applying pressure to form a compressed web.

The particle loading process is an additional processing step to a standard meltblown fiber forming process, as disclosed in, for example, commonly assigned U.S. Patent Publication No. 2006/0096911. Blown microfibers (BMF) are created by a molten polymer entering and flowing through a die, the flow being distributed across the width of the die in the die cavity and the polymer exiting the die through a series of orifices as filaments. In one embodiment, a heated air stream passes through air manifolds and an air knife assembly adjacent to the series of polymer orifices that form the die exit (tip). This heated air stream can be adjusted for both temperature and velocity to attenuate (draw) the polymer filaments down to the desired fiber diameter. The BMF fibers are conveyed in this turbulent air stream towards a rotating surface where they collect to form a web.

The porous polymeric particles are loaded into a particle hopper (or dropper) where they gravimetrically fill recessed cavities in a feed roll. A rigid or semi-rigid doctor blade with segmented adjustment zones forms a controlled gap against the feed roll to restrict the flow out of the hopper. The doctor blade is normally adjusted to contact the surface of the feed roll to limit particle flow to the volume that resides in the recesses of the feed roll. The feed rate can then be controlled by adjusting the speed that the feed roll turns. A brush roll operates behind the feed roll to remove any residual particles from the recessed cavities. The particles fall into a chamber that can be pressurized with compressed air or other source of pressured gas. This chamber is designed to create an airstream that will convey the particles and cause the porous polymeric particles to mix with the meltblown fibers being attenuated and conveyed by the air stream exiting the meltblown die.

In certain embodiments, binding of the porous polymeric particles to the fibrous substrate and the providing a fibrous substrate comprises i) extruding meltblown fibers comprising a polymeric material; ii) metering porous polymeric particles into the meltblown fibers; and iii) collecting the meltblown fibers and the porous polymeric particles as a nonwoven fibrous substrate comprising porous polymeric particles bound to the fibrous substrate.

By adjusting the pressure in the forced air particle stream, the velocity distribution of the particles is changed. When very low particle velocity is used, the particles may be diverted by the die airstream and not mix with the fibers. At low particle velocities, the particles may be captured only on the top surface of the web. As the particle velocity increases, the particles begin to more thoroughly mix with the fibers in the meltblown airstream and can form a uniform distribution in the collected web. As the particle velocity continues to increase, the particles partially pass through the meltblown airstream and are captured in the lower portion of the collected web. At even higher particle velocities, the particles can totally pass through the meltblown airstream without being captured in the collected web.

In another embodiment, the porous polymeric particles are sandwiched between two filament airstreams by using two generally vertical, obliquely-disposed dies that project generally opposing streams of filaments toward the collector. Meanwhile, particles pass through the hopper and into a first chute. The particles are gravity fed into the stream of filaments. The mixture of particles and fibers lands against the collector and forms a self-supporting nonwoven particle-loaded nonwoven web.

In other embodiments, the particles are provided using a vibratory feeder, eductor, or other techniques known to those skilled in the art.

The resulting article is a dry sheet having an average thickness of at least 50 micrometers, at least 100 micrometers, at least 250 micrometers, at least 500 micrometers, at least 800 micrometers, at least 1,500 micrometers, or at least 2,500 micrometers. The average thickness is often up to 3,000 micrometers, up to 2,000 micrometers, up to 1,000 micrometers, up to 600 micrometers, up to 400 micrometers, or up to 300 micrometers.

In the article, at least some of the porous polymeric particles are bound in the fibrous substrate through either fusing (direct connection between the particles and the substrate) or adhering via adhesives and/or binders, depending upon the nature of the fibers that are utilized. In certain embodiments, at least 50% of the porous polymeric particles are bound to the fibrous substrate. Stated another way, up to 50% of the porous polymeric particles can be entrapped in the fibrous substrate without being fused to one or more fibers or adhered to the fibrous substrate with an adhesive or a binder. In some embodiments, at least 25% of the porous polymeric particles, or at least 30%, or at least 40%, or at least 50%, or at least 60%, or at least 70% of the porous polymeric particles are fused to the fibrous substrate. The porous polymeric particles are often preferably distributed essentially uniformly throughout the fibrous substrate within the article.

Generally the average pore size of the dry porous article can be in a range of 0.1 to 10 micrometers, as measured by scanning electron microscopy (SEM). Void volumes in the range of 20 to 80 volume percent or in a range of 40 to 60 volume percent can be useful. The porosity of the article can be modified (increased) by using fibers of larger diameter or stiffness in the fibrous substrate.

The porous article can be flexible (for example, it can be a porous sheet rolled around a 0.75 inch (about 2 cm) diameter core). This flexibility can enable the sheet to be pleated, folded, or rolled. The porous sheet has an open pore structure that tends to provide minimal resistance to the passage of fluid. Because of this minimal resistance, relatively high volumes of liquid can be relatively quickly passed through it.

Various embodiments are provided that include an article and a method of making an article.

Embodiment 1 is an article that includes 1) a fibrous substrate and 2) porous polymeric particles, wherein at least 50% of the porous polymeric particles are bound to the fibrous substrate. The porous polymeric particles include a polymerized product of a reaction mixture that contains i) a monomer composition and ii) a poly(propylene glycol) having a weight average molecular weight of at least 500 grams/mole. The monomer composition contains at least 10 weight percent of a first monomer of Formula (I) based on a total weight of the monomer composition.

$$CH_2{=}C(R^1){-}(CO){-}O[{-}CH_2{-}CH_2{-}O]_p{-}(CO){-}C(R^1){=}CH_2 \quad (I)$$

In Formula (I), the variable p is an integer equal to at least 1 and $R^1$ is hydrogen or alkyl. The poly(propylene glycol) is removed from the polymerized product to provide the porous polymeric particles.

Embodiment 2 is the article of embodiment 1, wherein the fibrous substrate is nonwoven.

Embodiment 3 is the article of embodiment 1 or 2, wherein the fibrous substrate includes blown melt fibers.

Embodiment 4 is the article of any of embodiments 1 to 3, wherein the fibrous substrate includes fibers selected from polyolefins, polyesters, polyamides, polyurethanes, rubber elastomers, or combinations thereof.

Embodiment 5 is the article of any of embodiments 1 to 4, wherein the fibrous substrate includes fibers selected from polyethylene, polypropylene, polybutylene, polyethylene terephthalate, polybutylene terephthalate, nylon 6, nylon 66, polyester elastomers, or combinations thereof.

Embodiment 6 is the article of any of embodiments 1 to 5, wherein the fibrous substrate includes fibers having a lower glass transition temperature than the degradation temperature of the porous polymeric particles.

Embodiment 7 is the article of any of embodiments 1 to 6, wherein the reaction mixture used to form the porous polymeric particles includes (a) a first phase and (b) a second phase dispersed in the first phase, wherein a volume of the first phase is greater than a volume of the second phase. The first phase contains (i) a compound of Formula (II) and (ii) a nonionic surfactant.

$$HO[—CH_2—CH(OH)—CH_2—O]_n—H \quad (II)$$

In Formula (II), the variable n is an integer equal to at least 1. The second phase contains (i) a monomer composition comprising the monomer of Formula (I) and (ii) a poly (propylene glycol) having a weight average molecular weight of at least 500 grams/mole.

$$CH_2{=}C(R^1)—(CO)—O[—CH_2—CH_2—O]_p—(CO)—C(R^1){=}CH_2 \quad (I)$$

In Formula (I), the variable p is an integer equal to at least 1 and $R^1$ is hydrogen or methyl. The poly(propylene glycol) is removed from the polymerized product to provide the porous polymeric particles.

Embodiment 8 is the article of any of embodiments 1 to 7, wherein the monomer composition further contains a second monomer having one (meth)acryloyl group.

Embodiment 9 is the article of any of embodiments 1 to 8, wherein the monomer composition further contains a second monomer of Formula (III) or Formula (IV)

$$CH{=}CR^1—(CO)—O—Y—R^2 \quad (III)$$

$$CH_2{=}CR^1—(CO)—O—R^3 \quad (IV)$$

In Formula (III) and Formula (IV), the group $R^1$ is hydrogen or methyl. The group Y is a single bond, alkylene, oxyalkylene, or poly(oxyalkylene). The group $R^2$ is a carbocyclic group or heterocyclic group. The group $R^3$ is a linear or branched alkyl.

Embodiment 10 is the article of any of embodiments 1 to 8, wherein the monomer composition further contains a second monomer that is a hydroxyl-containing monomer of Formula (V) or Formula (VI).

$$CH_2{=}CR^1—(CO)—O—R^4 \quad (V)$$

$$CH_2{=}CR^1—(CO)—O—R^5\text{-}O—Ar \quad (VI)$$

In Formula (V) and Formula (VI), the group $R^1$ is hydrogen or methyl. The group $R^4$ is an alkyl substituted with one or more hydroxyl groups or is a group of formula $—(CH_2CH_2O)_qCH_2CH_2OH$ where the variable q is an integer equal to at least 1. The group $R^5$ is an alkylene substituted with at least one hydroxyl group and the group Ar is an aryl group.

Embodiment 11 is the article of any of embodiments 1 to 8, wherein the monomer composition further contains a second monomer having an ionic group.

Embodiment 12 is the article of any of embodiments 1 to 11, wherein the porous polymeric particles include particles in the form of hollow beads.

Embodiment 13 is the article of any of embodiments 1 to 12, wherein an active agent or moisture is adsorbed within at least some of the pores of the porous polymeric particles.

Embodiment 14 is the article of embodiment 13, wherein the active agent includes an antimicrobial agent.

Embodiment 15 is the article of any of embodiments 1 to 14, wherein at least 25% of the porous polymeric particles are fused to the fibrous substrate.

Embodiment 16 is the article of any of embodiments 1 to 15, wherein at least some of the porous polymeric particles are bound to the fibrous substrate with an adhesive, a binder, or a combination thereof.

Embodiment 17 is the article of any of embodiments 1 to 16, wherein the porous polymeric particles have an average diameter in the range of 1 micrometers (μm) to 200 μm.

Embodiment 18 is the article of any of embodiments 1 to 17, wherein the article includes 5 to 90 weight percent porous polymeric particles based on a total weight of the fibrous substrate with the bound porous polymeric particles.

Embodiment 19 is the article of any of embodiments 1 to 18, wherein the article includes 15 to 57 weight percent porous polymeric particles based on a total weight of the fibrous substrate with the bound porous polymeric particles.

Embodiment 20 is the article of any of embodiments 1 to 19, wherein the fibrous substrate includes fibers having an average diameter in a range of from 1μm to 50 μm.

Embodiment 21 is the article of any of embodiments 1 to 20, wherein the article has an average thickness of from 50 μm to 3,000 μm.

Embodiment 22 is the article of any of embodiments 1 to 21, wherein upon immersion in water for 1 hour, the article does not expand in length in any direction.

Embodiment 23 is a method of making an article that includes a) providing porous polymeric particles; b) providing a fibrous substrate comprising fibers; and c) binding the porous polymeric particles to the fibrous substrate. At least 50% of the porous polymeric particles are bound to the fibrous substrate. The porous polymeric particles include a polymerized product of a reaction mixture that contains i) a monomer composition comprising at least 10 weight percent of a first monomer of Formula (I) based on a total weight of the monomer composition, and ii) a poly(propylene glycol) having a weight average molecular weight of at least 500 grams/mole.

$$CH_2{=}C(R^1)—(CO)—O[—CH_2—CH_2—O]_p—(CO)—C(R^1){=}CH_2 \quad (I)$$

In Formula (I), the integer p is equal to at least 1 and $R^1$ is hydrogen or alkyl. The poly(propylene glycol) is removed from the polymerized product to provide the porous polymeric particles.

Embodiment 24 is the method of embodiment 23, wherein the binding includes i) heating the fibrous substrate to a temperature above the glass transition temperature of the fibers; ii)

contacting the porous polymeric particles with the heated fibrous substrate; and iii) cooling the porous polymeric particles and fibrous substrate to fuse porous polymeric particles to the fibrous substrate.

Embodiment 25 is the method of embodiment 23, wherein the binding the porous polymeric particles to the fibrous substrate is performed simultaneously with the providing a fibrous substrate.

Embodiment 26 is the method of embodiment 25, wherein the binding the porous polymeric particles to the fibrous substrate and the providing a fibrous substrate includes i) extruding meltblown fibers comprising a polymeric material; ii) metering porous polymeric particles into the meltblown fibers; and iii) collecting the meltblown fibers and the porous polymeric particles as a nonwoven fibrous substrate including porous polymeric particles bound to the fibrous substrate.

Embodiment 27 is the method of embodiment 26, wherein the porous polymeric particles are metered using a particle dropper comprising a feed roll.

Embodiment 28 is the method of embodiment 27, wherein a speed of the feed roll is adjusted to regulate the amount of porous polymeric particles bound to the fibrous substrate.

Embodiment 29 is the method of any of embodiments 26 to 28, wherein the meltblown fibers and the porous polymeric particles are collected on a vacuum collection drum roll.

Embodiment 30 is the method of any of embodiments 23 to 29, wherein the fibrous substrate is nonwoven.

Embodiment 31 is the method of any of embodiments 23 to 30, wherein the fibrous substrate includes blown melt fibers.

Embodiment 32 is the method of any of embodiments 23 to 31, wherein the fibrous substrate includes fibers selected from polyolefins, polyesters, polyamides, polyurethanes, rubber elastomers, or combinations thereof.

Embodiment 33 is the method of any of embodiments 23 to 32, wherein the fibrous substrate includes fibers selected from polyethylene, polypropylene, polybutylene, polyethylene terephthalate, polybutylene terephthalate, nylon 6, nylon 66, polyester elastomers, or combinations thereof.

Embodiment 34 is the method of any of embodiments 23 to 33, wherein the fibrous substrate includes fibers having a lower glass transition temperature than the degradation temperature of the porous polymeric particles.

Embodiment 35 is the method of any of embodiments 23 to 34, wherein the reaction mixture contains 1) a first phase having a first volume and comprising i) a compound of Formula (II); and ii) a nonionic surfactant.

$$HO(—CH_2CH(OH)CH_2O)_n \quad II)$$

In Formula (II), the variable n is an integer equal to at least 1. The reaction mixture further contains 2) a second phase having a second volume and being dispersed in the first phase. The first volume is greater than the second volume. The second phase contains i) the monomer composition including at least 10 weight percent of the monomer of Formula (I) based on the total weight of the monomer composition; and ii) the poly(propylene glycol) having a weight average molecular weight of at least 500 grams/mole. The poly(propylene glycol) is removed from the polymerized product to provide the porous polymeric particles.

Embodiment 36 is the method of any of embodiments 23 to 35, wherein the monomer composition further contains a second monomer having one (meth)acryloyl group. Embodiment 37 is the method of any of embodiments 23 to 36, wherein the monomer composition further contains a second monomer of Formula (III) or Formula (IV).

$$CH_2{=}CR^1—(CO)—O—Y—R^2 \quad (III)$$

$$CH_2{=}CR^1—(CO)—O—R^3 \quad (IV)$$

In Formula (III) and Formula (IV), the group $R^1$ is hydrogen or methyl. The group Y is a single bond, alkylene, oxyalkylene, or poly(oxyalkylene). The group $R^2$ is a carbocyclic group or heterocyclic group. The group $R^3$ is a linear or branched alkyl.

Embodiment 38 is the method of any of embodiments 23 to 36, wherein the monomer composition further contains a second monomer that is a hydroxyl-containing monomer of Formula (V) or Formula (VI).

$$CH_2{=}CR^1—(CO)—O—R^4 \quad (V)$$

$$CH_2{=}CR^1—(CO)—O—R^5—O—Ar \quad (VI)$$

In Formula (V) and Formula (VI), the group $R^1$ is hydrogen or methyl. The group $R^4$ is an alkyl substituted with one or more hydroxyl groups or is a group of formula $—(CH_2CH_2O)_qCH_2CH_2OH$ where the variable q is an integer equal to at least 1. The group $R^5$ is an alkylene substituted with at least one hydroxyl group and the group Ar is an aryl group.

Embodiment 39 is the method of any of embodiments 23 to 36, wherein the monomer composition further contains a second monomer having an ionic group.

Embodiment 40 is the method of any of embodiments 23 to 39, wherein the porous polymeric particles include particles in the form of hollow beads.

Embodiment 41 is the method of any of embodiments 23 to 40, wherein an active agent or moisture is adsorbed within at least some of the pores of the porous polymeric particles.

Embodiment 42 is the method of embodiment 41, wherein the active agent includes an antimicrobial agent.

Embodiment 43 is the method of any of embodiments 23 to 42, wherein at least 25% of the porous polymeric particles are fused to the fibrous substrate.

Embodiment 44 is the method of any of embodiments 23 to 43, wherein at least some of the porous polymeric particles are bound to the fibrous substrate with an adhesive, a binder, or a combination thereof.

Embodiment 45 is the method of any of embodiments 23 to 44, wherein the porous polymeric particles have an average diameter in the range of 1μm to 200 μm.

Embodiment 46 is the method of any of embodiments 23 to 45, wherein the article includes 5 to 90 weight percent porous polymeric particles based on a total weight of the fibrous substrate with the bound porous polymeric particles.

Embodiment 47 is the method of any of embodiments 23 to 46, wherein the article includes 15 to 57 weight percent porous polymeric particles based on a total weight of the fibrous substrate with the bound porous polymeric particles.

Embodiment 48 is the method of any of embodiments 23 to 47, wherein the fibrous substrate includes fibers having an average diameter in a range of from 1μm to 50 μm.

Embodiment 49 is the method of any of embodiments 23 to 48, wherein the article has an average thickness of from 50 μm to 3,000 μm.

Embodiment 50 is the method of any of embodiments 23 to 49, wherein upon immersion in water for 1 hour, the article does not expand in length in any direction.

EXAMPLES

Unless otherwise noted, all chemicals used in the examples can be obtained from Sigma-Aldrich Corp. (Saint Louis, Mo. Unless otherwise specified, all microbiological supplies and reagents were purchased as standard products from either Sigma-Aldrich or VWR.

TABLE 1

| Materials | |
|---|---|
| Designation | Description |
| APG 325N | Nonionic alkyl polyglucoside surfactant, obtained from Cognis Corporation (Cincinnati, OH) |
| HYTREL G3548L | HYTREL ™ G3548L, a thermoplastic poly butylenes/poly(alkylene ether) phthalate available from DuPont (Wilmington, DE, USA) |
| IPA | Isopropyl alcohol, obtained from Sigma Aldrich (St. Louis, MO, USA) |
| IRGACURE 819 | Trade designation for the photoinitiator bis(2,4,6-trimethylbenzoyl)-phenylphosphineooxide, obtained from BASF (Florham Park, NJ, USA) |
| PPG | Polypropylene glycol having a weight average molecular weight of 4000 grams/mole, obtained from Alfa Aesar (Ward Hill, MA, USA) |
| SEMA | Monomer available from Scientific Polymer, Inc. (Ontario, NY, USA) |
| SR 339 | Trade designation for 2-phenoxyethyl acrylate ester obtained from Sartomer Company, Inc. (Exton, PA, USA) |
| SR 6030 | Trade designation for polyethylene glycol 400 dimethacrylate with a weight average molecular weight of 400 grams/mole obtained from Sartomer Company, Inc. (Exton, PA, USA) |

Preparative Example 1

(PE-1): Synthesis of Nanoporous Microparticles

The monomers SR 339 (50 grams), SR 6030 (50 grams) and SEMA (5 grams) were mixed with PPG (43 grams) and IRGACURE 819 (250 milligrams). The mixture was stirred vigorously for 20 minutes on gentle heat of about 40° C. to 50° C. This mixture was then added to 300 grams of glycerol previously mixed with 15 g of the surfactant APG 325N. The mixture was shear mixed for 20 minutes. The mixture was then spread thin between two sheets of polyethylene terephthalate (PET) film which can be obtained from DuPont (Wilmington, Del., USA) under the trade designation ST 500. The mixture was cured with ultraviolet light for 15 to 20 minutes with a 100 Watts, long-wavelength BLACK RAY UV lamp (obtained from UVP, LLC of Upland, Calif., USA) situated at about 15 centimeters (6 inches) from the surface of the material being cured.

The cured mixture was separated from the PET films and then dispersed in excess IPA (500 mL), shaken for 30 minutes, and centrifuged for 10 minutes at 3000 rpm in an EPPENDORF 5810 R centrifuge (obtained from Eppendorf in Germany). The supernatant was removed and the resulting particles were then re-suspended in 500 mL of IPA for a second rinse followed by centrifugation. The particles were again re-suspended in IPA, rinsed and centrifuged. The particles were oven-dried overnight at 70° C. FIG. 1 is a digital SEM image of the particles from PE-1.

Example 1

(EX-1) to Example 4 (EX-4): Meltblown Capture of Nanoporous Microparticles

Figure 2:
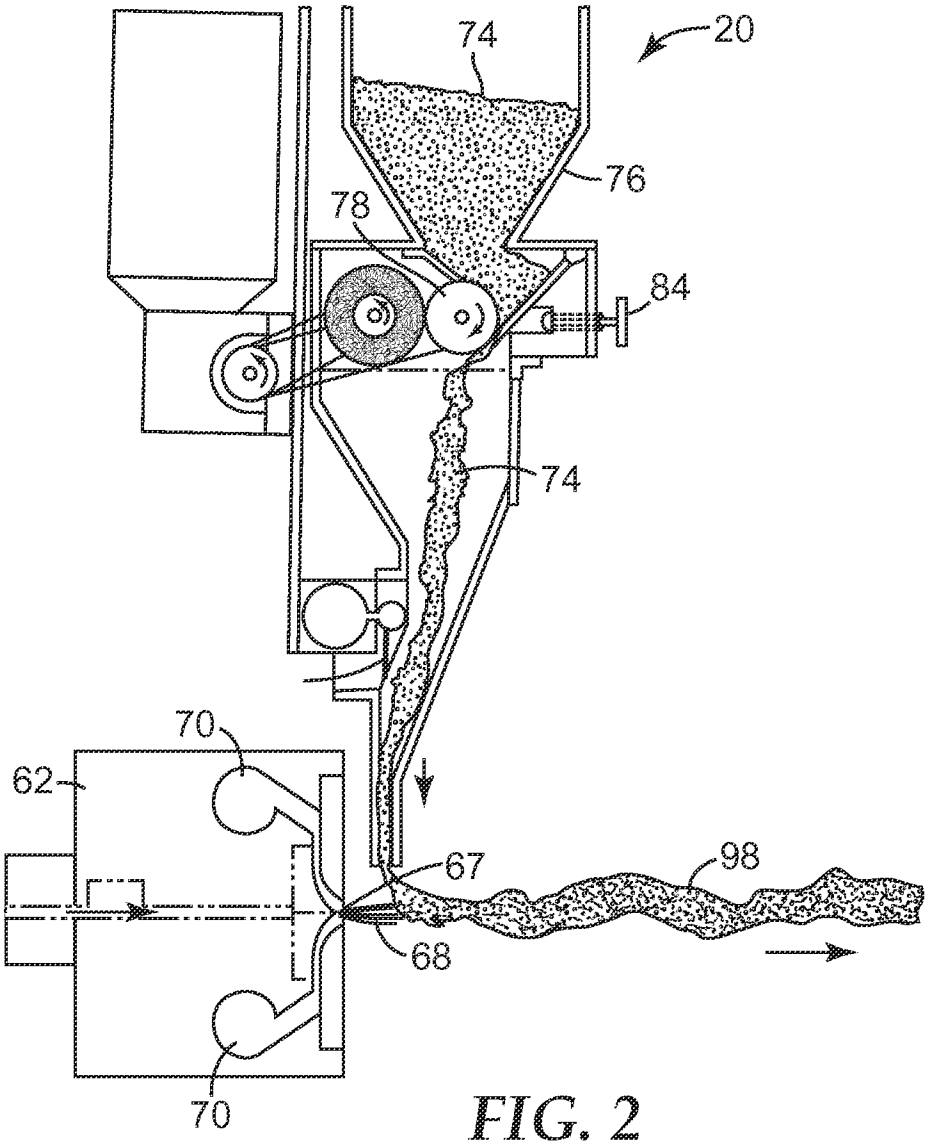
FIG. 2 is schematic cross-sectional view of a meltblowing apparatus for making porous articles.

The particle loaded fibrous webs were made using a meltblowing apparatus 20 with a single horizontal stream of filaments as shown in FIG. 2. In this process, the HYTREL G3548L polymer was extruded through a drilled orifice die 62 at a temperature of 260° C., attenuated by top and bottom air 70 into finer fibers 68, and collected using a vacuum drum roll at a 15 cm die-to-collector distance. The extrusion rate and other processing parameters were adjusted to produce a fibrous web 98 with an effective fiber diameter between 20 and 30 micrometers.

Figure 3:
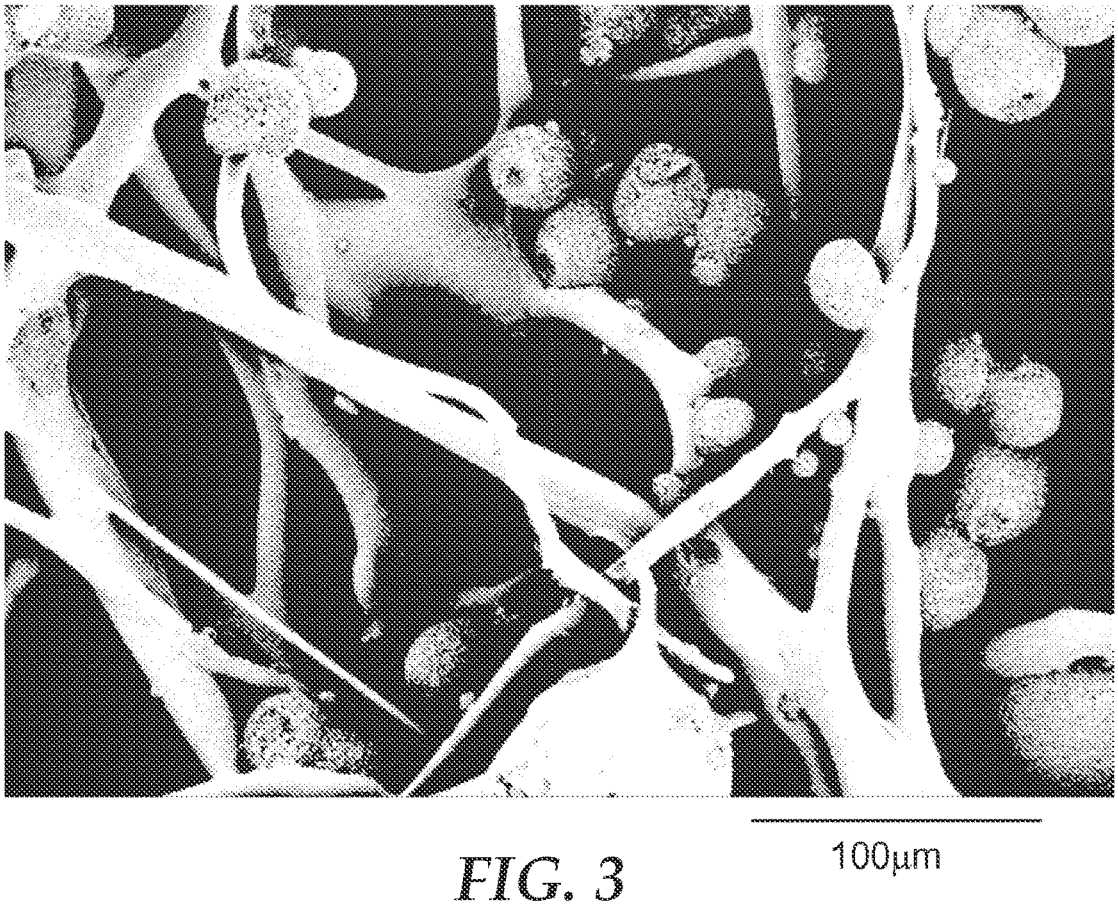
FIG. 3 is the scanning electron micrograph of the article of Example 1.

Particles 74 from PE-1 were metered from a hopper 76 using a knurled feed roll 78 onto the horizontal stream of fibers 68 at a distance of 2 to 5 cm from the die tip 67. As the particles dropped on the hot meltblown fibers 68, they were captured by the fibers (see FIG. 3). For each of Examples 1 to 4, the speed of the feed roll was adjusted in order to create webs of different weight percentages of nanoporous microparticles loaded onto the meltblown fibrous web (i.e., EX-1=15 wt. %; EX-2=31 wt. %; EX-3=48 wt. % and EX-4=57 wt. %), where the fibrous web had a weight of 117 to 233 g/m$^2$.

TABLE 2

| Weight density and particle loading percentages of the meltblown | | |
|---|---|---|
| Particle-loaded meltblown fibrous web | Web weight, g/m$^2$ | Weight percent of nanoporous particles in the particle-loaded meltblown web |
| EX-1 | 117 | 15 |
| EX-2 | 145 | 31 |
| EX-3 | 193 | 48 |
| EX-4 | 233 | 57 |

Comparative Example 1

(Comp-1): Meltblown Fibrous Web

A meltblown fibrous web was prepared using the G348L material in the same process EX-1 to EX-4 were made, except without particle loading. The particle-free fibrous web had a basis weight of 100 g/m$^2$ and a thickness of 270 micrometer.

Water Vertical Wicking Testing

Particle-loaded meltblown materials from EX-1 to EX-4 and comparative example Comp-1 were cut into 1.6 cm by 12 cm strips, and an end of each strip was dipped into a pan holding deionized water. Over a period of 100 seconds, the water wicked up the strips, as summarized in Table 3.

TABLE 3

| Vertical wicking of water | | |
|---|---|---|
| Particle-loaded meltblown material | Weight percent of nanoporous microparticles in the particle-loaded meltblown web | Water wicking distance after 100 seconds, cm |
| Comp-1 (control) | 0 | 3.6 |
| EX-1 | 15 | 7.3 |
| EX-2 | 31 | 8.2 |
| EX-3 | 48 | 9.1 |
| EX-4 | 57 | 10 |

The data in Table 3 show that the vertical wicking of water was better with the particle-loaded meltblown materials compared to the control, and improved with higher percentage of nanoporous microparticle loading in the fibrous web.

Water Absorption Testing

Particle-loaded meltblown materials from EX-1 to EX-4 and comparative example Comp-1 were cut into 1.6 cm by 12 cm strips, weighed to obtain a dry weight ("Dry Wt"), and soaked in deionized water for 1 minute. Then the strips were lifted vertically using a prong to drip excess water, held for 1 minute, and then weighed to obtain the wet weight ("Wet Wt"). Percentage absorption was calculated as:

$$\text{Percentage absorption, \%}=(\text{Wet Wt}-\text{Dry Wt})/\text{Dry Wt}\times 100$$

The data in Table 4 showed that the absorption capacity of the meltblown web increased by at least three times with the incorporation of the nanoporous particles in the web.

TABLE 4

| Water absorption capacity of the particle-loaded meltblown webs | |
|---|---|
| Material | Percentage absorption, wt. % |
| Comp-1 (control) | 47 |
| EX-1 | 174 |
| EX-2 | 228 |
| EX-3 | 255 |
| EX-4 | 283 |

Wicking/Evaporation Performance Testing

Figure 4:
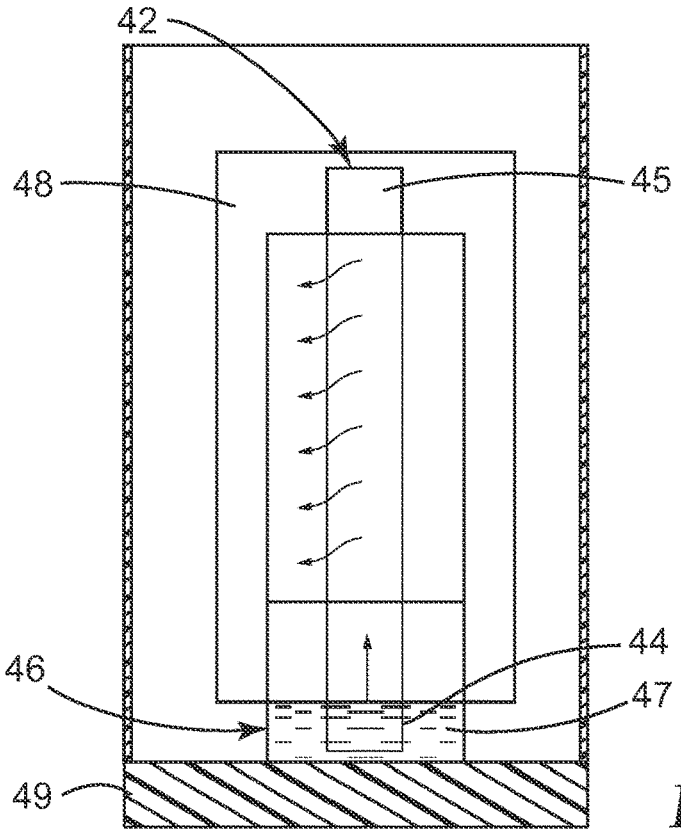
FIG. 4 is a schematic of the experimental setup described in the Wicking/Evaporation Performance Testing examples.
Figure 5:
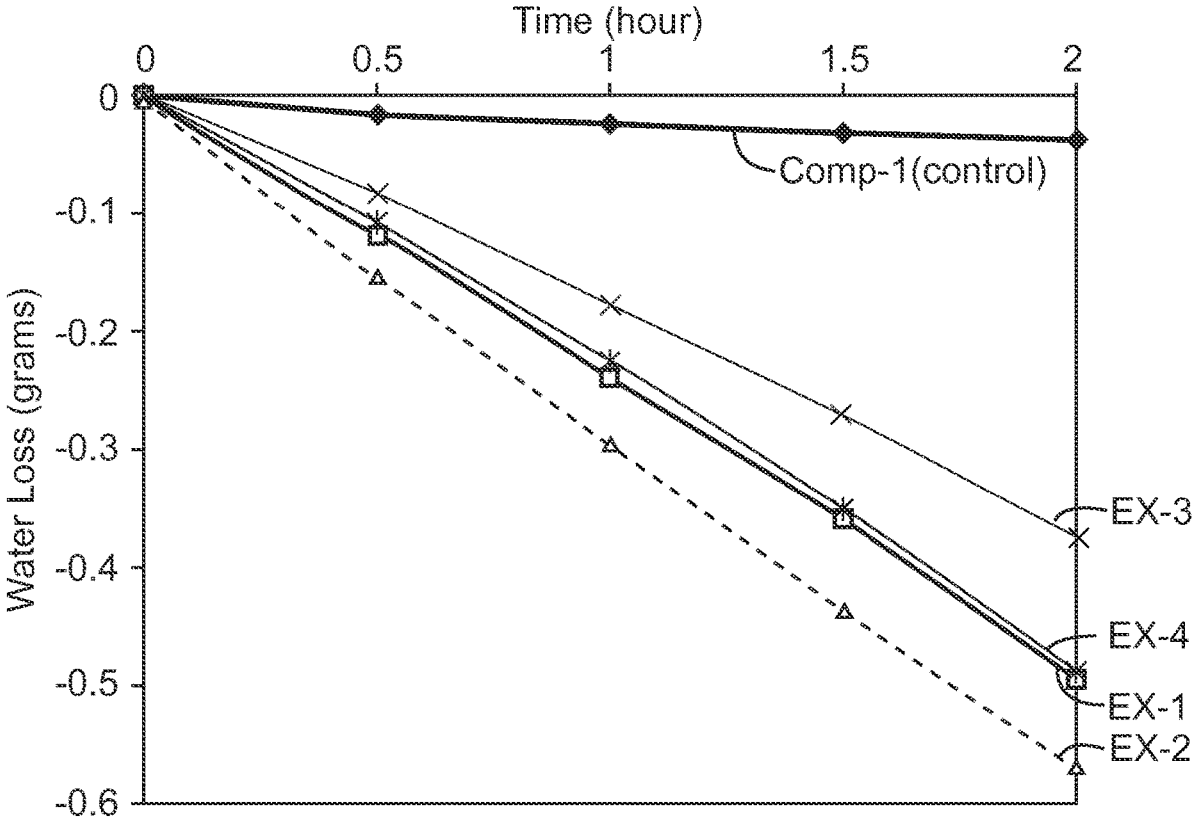
FIG. 5 is a graph of water loss versus time described in the Wicking/Evaporation Performance Testing examples.

Particle-loaded meltblown materials from EX-1 to EX-4 and comparative example Comp-1 were cut into 1.6 cm by 12 cm strips. As shown in FIG. 4, for each strip 42, an end 44 of the strip was inserted through a 0.3 cm by 1.9 cm slit in a bottle cap and then dipped into the bottle 46 containing deionized water 47, while the other end 45 of the strip was extended outside the bottle 46 and taped to a holder 48. The bottle 46 and strip 42 were then placed on a scale 49 that was shielded from the sides and with an open top in room temperature of 23° C. The weight loss was measured every 30 minutes for a period of 2 hours. The water weight loss results were summarized in Table 5, and the weight loss results in Table 5 were also plotted as in FIG. 5 to illustrate the water loss versus time.

TABLE 5

| Water loss from the wicking/evaporation test | | | | | |
|---|---|---|---|---|---|
| | Water loss (grams) | | | | |
| Material | t = 0 hr | t = 0.5 hr | t = 1 hr | t = 1.5 hr | t = 2 hr |
| Comp-1 (control) | 0 | −0.013 | −0.022 | −0.030 | −0.036 |
| EX-1 | 0 | −0.116 | −0.238 | −0.357 | −0.493 |
| EX-2 | 0 | −0.152 | −0.295 | −0.437 | −0.569 |

TABLE 5-continued

| Water loss from the wicking/evaporation test | | | | | |
|---|---|---|---|---|---|
| | Water loss (grams) | | | | |
| Material | t = 0 hr | t = 0.5 hr | t = 1 hr | t = 1.5 hr | t = 2 hr |
| EX-3 | 0 | −0.080 | −0.175 | −0.270 | −0.373 |
| EX-4 | 0 | −0.105 | −0.223 | −0.350 | −0.486 |

What is claimed is:

1. An article comprising: 1) a fibrous substrate and 2) porous polymeric particles, wherein at least 50% of the porous polymeric particles are bound to the fibrous substrate, wherein the fibrous substrate comprises fibers having a lower glass transition temperature than the degradation temperature of the porous polymeric particles, and wherein the porous polymeric particles comprise a polymerized product of a reaction mixture comprising:

1) a first phase having a first volume and comprising i) a compound of Formula (II)

$$HO(—CH_2CH(OH)CH_2O)_n—H \quad (II)$$

wherein n is an integer equal to at least 1; and ii) a nonionic surfactant;

2) a second phase having a second volume and being dispersed in the first phase, wherein the first volume is greater than the second volume and wherein the second phase comprises i) a monomer composition comprising at least 10 weight percent of a first monomer of Formula (I)

$$CH_2{=}C(R^1)—(CO)—O[—CH_2—CH_2—O]_p—(CO)—C(R^1){=}CH_2 \quad (I)$$

based on a total weight of the monomer composition, wherein p is an integer equal to at least 1 and $R^1$ is hydrogen or alkyl;

ii) at least one second monomer comprising a monomer of Formula (III)

$$CH_2{=}CR^1—(CO)—O—Y—R^2 \quad (III)$$

wherein $R^1$ is hydrogen or methyl;

Y is a single bond, alkylene, oxyalkylene, or poly (oxyalkylene); and $R^2$ is a carbocyclic group or heterocyclic group; and iii) a poly(propylene glycol) having a weight average molecular weight of at least 500 grams/mole, wherein the poly(propylene glycol) is removed from the polymerized product to provide the porous polymeric particles.

2. The article of claim 1, wherein the fibrous substrate comprises blown melt fibers.

3. The article of claim 1, wherein the fibrous substrate comprises fibers selected from the group consisting of polyesters, polyamides, polyurethanes, rubber elastomers, or combinations thereof.

4. The article of any of claim 1, wherein the fibrous substrate comprises fibers selected the group consisting of polyethylene terephthalate, polybutylene terephthalate, nylon 6, nylon 66, polyester elastomers, and combinations thereof.

5. The article of any of claim 1, wherein the at least one second monomer further comprises a monomer of Formula (IV)

$$CH_2{=}CR^1—(CO)—O—R^3 \quad (IV)$$

wherein $R^1$ is hydrogen or methyl; and $R^3$ is a linear or branched alkyl.

6. The article of claim 1, wherein the at least one second monomer further comprises a hydroxyl-containing monomer of Formula (V) or Formula (VI)

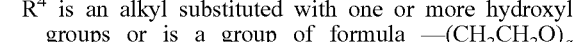

$$CH_2{=}CR^1{-}(CO){-}O{-}R^4 \quad (V)$$

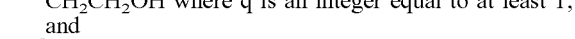

$$CH_2{=}CR^1{-}(CO){-}O{-}R^5{-}O{-}Ar \quad (VI)$$

wherein $R^1$ is hydrogen or methyl;

$R^4$ is an alkyl substituted with one or more hydroxyl groups or is a group of formula $-(CH_2CH_2O)_q CH_2CH_2OH$ where q is an integer equal to at least 1; and $R^5$ is an alkylene substituted with at least one hydroxyl group and the group Ar is an aryl group.

7. The article of any of claim 1, wherein an active agent comprising an antimicrobial agent or moisture is adsorbed within at least some of the pores of the porous polymeric particles.

8. The article of any of claim 1, wherein at least some of the porous polymeric particles are bound to the fibrous substrate with an adhesive, a binder, or a combination thereof.

9. The article of any of claim 1, wherein upon immersion in water for 1 hour, the article does not expand in length in any direction.

10. The article of claim 1, wherein at least 25% of the porous polymeric particles are fused to the fibrous substrate.

11. The article of claim 1, wherein the article comprises 15 to 55 weight percent porous polymeric particles, based on a total dry weight of the article.

12. The article of claim 1, wherein the article consists of the fibrous substrate and the porous polymeric particles.

13. The article of claim 1, wherein the fibers comprise hydrophilic fibers.

14. The article of claim 1, wherein the porous polymeric particles include particles in the form of hollow beads.

15. A method of making an article, the method comprising:

a) providing porous polymeric particles comprising a polymerized product of a reaction mixture comprising:

1) a first phase having a first volume and comprising i) a compound of Formula (II)

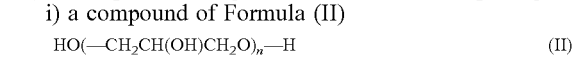

$$HO(-CH_2CH(OH)CH_2O)_n-H \quad (II)$$

wherein n is an integer equal to at least 1; and ii) a nonionic surfactant;

2) a second phase having a second volume and being dispersed in the first phase, wherein the first volume is greater than the second volume and wherein the second phase comprises i) a monomer composition comprising at least 10 weight percent of a first monomer of Formula (I)

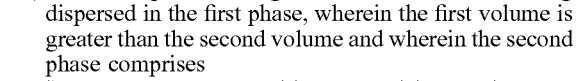

$$CH_2{=}C(R^1){-}(CO){-}O[-CH_2-CH_2\text{-}O]_p{-}(CO){-}C(R^1){=}CH_2 \quad (I)$$

based on a total weight of the monomer composition, wherein p is an integer equal to at least 1 and $R^1$ is hydrogen or alkyl;

ii) at least one second monomer comprising a monomer of Formula (III)

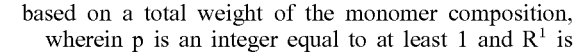

$$CH_2{=}CR^1{-}(CO){-}O{-}Y{-}R^2 \quad (III)$$

wherein $R^1$ is hydrogen or methyl;

Y is a single bond, alkylene, oxyalkylene, or poly (oxyalkylene);

$R^2$ is a carbocyclic group or heterocyclic group; and iii) a poly(propylene glycol) having a weight average molecular weight of at least 500 grams/mole, wherein the poly(propylene glycol) is removed from the polymerized product to provide the porous polymeric particles;

wherein the poly(propylene glycol) is removed from the polymerized product to provide the porous polymeric particles;

b) providing a fibrous substrate comprising fibers, wherein the fibrous substrate comprises fibers having a lower glass transition temperature than the degradation temperature of the porous polymeric particles; and c) binding the porous polymeric particles to the fibrous substrate, wherein at least 50% of the porous polymeric particles are bound to the fibrous substrate.

16. The method of claim 15, wherein the binding comprises:

i) heating the fibrous substrate to a temperature above the glass transition temperature of the fibers;

ii) contacting the porous polymeric particles with the heated fibrous substrate; and iii) cooling the porous polymeric particles and fibrous substrate to fuse porous polymeric particles to the fibrous substrate.

17. The method of claim 15, wherein the binding the porous polymeric particles to the fibrous substrate is performed simultaneously with the providing a fibrous substrate.

18. The method of claim 17, wherein the binding the porous polymeric particles to the fibrous substrate and the providing a fibrous substrate comprises:

i) extruding meltblown fibers comprising a polymeric material;

ii) metering porous polymeric particles into the meltblown fibers; and iii) collecting the meltblown fibers and the porous polymeric particles as a nonwoven fibrous substrate comprising porous polymeric particles bound to the fibrous substrate.

19. The method of claim 18, wherein the porous polymeric particles are metered using a particle dropper comprising a feed roll.

20. The method of claim 15, wherein at least 25% of the porous polymeric particles are fused to the fibrous substrate.

* * * * *